US008887789B2

(12) United States Patent
Tremaine, III et al.

(10) Patent No.: US 8,887,789 B2
(45) Date of Patent: Nov. 18, 2014

(54) RETRACTABLE, LOW-PROFILE STORM SHIELD SYSTEMS AND METHODS

(75) Inventors: Burton G. Tremaine, III, Essex, CT (US); Victor Rivera, Port St. Lucie, FL (US)

(73) Assignee: Storm Solutions, Inc., Essex, CT (US)

( * ) Notice: Subject to any disclaimer, the term of this patent is extended or adjusted under 35 U.S.C. 154(b) by 0 days.

(21) Appl. No.: 13/208,760

(22) Filed: Aug. 12, 2011

(65) Prior Publication Data

US 2011/0296774 A1 Dec. 8, 2011

Related U.S. Application Data

(63) Continuation-in-part of application No. 12/882,331, filed on Sep. 15, 2010.

(60) Provisional application No. 61/242,466, filed on Sep. 15, 2009, provisional application No. 61/346,490, filed on May 20, 2010.

(51) Int. Cl.

| | |
|---|---|
| ***A47G 5/02*** | (2006.01) |
| ***E06B 9/56*** | (2006.01) |
| ***A47H 1/00*** | (2006.01) |
| ***E06B 9/13*** | (2006.01) |
| ***E06B 9/06*** | (2006.01) |
| ***E06B 9/58*** | (2006.01) |
| *E06B 9/00* | (2006.01) |

(52) U.S. Cl.

CPC ..... *E06B 9/13* (2013.01); *E06B 9/0692* (2013.01); *E06B 9/581* (2013.01); *E06B 2009/005* (2013.01)

USPC ..... 160/273.1; 160/264

(58) Field of Classification Search

USPC ..... 160/273.1, 23.1, 309; 29/24.5

See application file for complete search history.

(56) References Cited

U.S. PATENT DOCUMENTS 2,132,986 A * 10/1938 Julien ..... 160/267.1
3,911,990 A * 10/1975 Hoover et al. ..... 160/100
5,025,847 A * 6/1991 Mueller ..... 160/270

(Continued)

FOREIGN PATENT DOCUMENTS

DE 202009003723 U1 5/2009

OTHER PUBLICATIONS

European Search Report dated Jul. 18, 2014.

*Primary Examiner* — Katherine Mitchell
*Assistant Examiner* — Jeremy Ramsey
(74) *Attorney, Agent, or Firm* — Troutman Sanders, LLP; Ryan A. Schneider

(57) ABSTRACT

A self-contained system for protecting building penetrations is disclosed. The system can include a housing containing a take-up roll and a screen made from a flexible, strong fabric-like material suitable for resisting high winds, driving rain, and wind-driven missiles. The system can further comprise a deflector or roller to maintain the angle of deployment of the screen. The system can further include a weight bar attached to the end of the screen to assist in deploying the screen. The system can further comprise a dual pulley system to assist in deploying the screen and to hold the screen in the deployed position. The system can include wipers to clean the screen as it is retracted into the enclosure. The system can further comprise an integrated or separate light control, or "black-out" screen. The system enclosures can comprise various hinged covers to facilitate service, repair, and storage.

23 Claims, 25 Drawing Sheets

(56) References Cited

U.S. PATENT DOCUMENTS

| | | | | | |
|---|---|---|---|---|---|
| 5,129,442 | A * | 7/1992 | Warner | ..... | 160/271 |
| 5,159,967 | A * | 11/1992 | Ashley et al. | ..... | 160/265 |
| 5,299,617 | A * | 4/1994 | Hying et al. | ..... | 160/271 |
| 6,691,761 | B1 * | 2/2004 | Alkhoury et al. | ..... | 160/273.1 |
| 6,873,461 | B1 * | 3/2005 | McPherson, Jr. | ..... | 359/461 |
| 7,111,661 | B2 * | 9/2006 | Laugenbach | ..... | 160/270 |
| 7,360,575 | B2 * | 4/2008 | Weiss | ..... | 160/273.1 |
| 2011/0061822 | A1 | 3/2011 | Tremaine, III | | |

* cited by examiner

RETRACTABLE, LOW-PROFILE STORM SHIELD SYSTEMS AND METHODS

CROSS REFERENCE TO RELATED APPLICATIONS

This Application claims benefit under 35 U.S.C. §120 and is a continuation-in-part of U.S. patent application Ser. No. 12/882,331 filed 15 Sep. 2010, which claims benefit under 35 USC §119(e) of U.S. Provisional Patent Application Ser. No. 61/346,490 filed 20 May 2010 and U.S. Provisional Patent Application Ser. No. 61/242,466 filed 15 Sep. 2009. Each of the above-listed applications is herein incorporated by reference as if fully set forth below in their entireties.

BACKGROUND OF THE INVENTION

1. Field of the Invention

The present invention relates to a retractable system for protecting penetrations in buildings, and particularly to a retractable, flexible, low-profile, solar, insect, thermal, and storm ("SITS") protection system for windows and doors. The present invention enables a storage and deployment mechanism for roll-up storm protection screens that is approximately 50-60% smaller than conventional systems while containing approximately 45-55% greater vertical length of material. This smaller size eases installation and reduces the aesthetic impact of the system on the installation site. Space savings are maintained or improved as the size of the system increases, e.g., to protect larger openings.

2. Background of Related Art

Systems exist that attempt to mitigate damage to structures during inclement weather such as hurricanes, cyclones, nor'easters, and thunderstorms. These types of weather systems can carry with them high winds, hail, sleet, and driving rain. High winds can damage structures not only by creating high pressure forces and, for example, blowing out windows, but also by causing loose material and debris to become missiles impacting the structure. In addition, high winds can create driving rain that can penetrate, among other things, window and door seals causing flooding and water damage to the structure.

"Bahama" and/or colonial-type, conventional storm shutters have been used in an attempt to protect windows and doors during storms. These shutters are typically constructed of a rigid material such as, for example, plastic or metal, and are sized to cover the opening they protect. These types of shutters typically use an awkward safety bar to secure the shutters for use. Due in part to their custom construction, however, conventional storm shutters tend to be expensive and can be difficult to deploy.

Aluminum roll-up shutter systems are also available. These systems use multiple aluminum panels joined by hinges or pins to form a substantially solid but flexible curtain, similar to a roll-up garage door. These systems are generally available with electric or manual crank, or pull-down deployment. Due to the thickness of the aluminum panels, however, the systems tend to be heavy. Additionally, due to the limited range of motion of the hinges that join the panels, the take-up rolls that store aluminum shutters when not in use are large. As a result, the enclosures for these systems are necessarily large and cumbersome. This makes installation difficult and detracts from the aesthetics of the building on which they are installed. In addition, aluminum roll-up systems are solid and block most, if not all, of the natural light from the building when deployed. This provides a dark and unpleasant experience to the user, especially given that the power to the building is likely out (e.g., during hurricane).

In an attempt to reduce weight and increase visibility, retractable storm protection systems have been developed. These systems typically use a strong, flexible, fabric screen made of, for example, polypropylene, PVC coated aramid fabric (e.g., Kevlar®), Mylar®, polyester, or hybrids thereof. The systems can further comprise a retracting mechanism and a housing in which to store the screen when not in use. The screen is deployed to cover the window or door and is generally retained in vertical tracks installed in, or on, the window or door opening. Conventionally, the screen is retained in the track either by, for example, sewing, welding (e.g., radio frequency welding), or both, a hem cord to the vertical sides of the fabric (as used herein, the "hem cord method"), or simply by folding the screen over on itself and sewing, welding, or both, a hem into the edge of the screen (as used herein, the "hem-only method").

At one end of the spectrum, a hem cord method enables the screen to be retained in a slotted track because the slot is considerably smaller than the diameter of the hem cord. This method retains the screen in the track at fairly high forces because the diameter of the hem cord is sufficiently large when compared to the slot in the track. Unfortunately, the thick, stiff hem cord requires a large diameter take-up roll on which to retract the fabric (i.e., when the screen is not deployed). This, in turn, necessitates a large housing, increasing installation difficulty and detracting from the aesthetics of the building, among other things.

At the other end of the spectrum, the hem-only method involves a hem sewn into the edge of the fabric that can enable it to be retained in a sufficiently small slot in the track. Because the hem is generally only approximately twice the thickness of the fabric itself, this method has a limited ability to retain the screen in the track. As a result, the application of such systems is limited to smaller openings to minimize pressure forces on the screen. In other words, at larger opening sizes, such as a large door or window, the force created by high winds can exceed the ability of the system to retain the screen. Additionally, the necessarily tight slot in the retaining track can cause jams and hinder operation when deploying or retracting the screen.

What is needed, therefore, is a system that combines the retention strength of the conventional hem cord system, with the reduced storage requirements of the hem-only method. It is to such a system that embodiments of the present invention are primarily directed.

BRIEF SUMMARY OF THE INVENTION

Embodiments of the present invention relate generally to storm protection systems and more specifically to a flexible, retractable storm protection system with reduced volume and increased protection. The system can comprise a screen made of a strong flexible material, or a composite of such materials. The screen material can comprise, for example and not limitation, a PVC coated aramid fabric (e.g., Kevlar®), Mylar®, vinyl, nylon, polyester, polypropylene, or fiberglass, or combinations thereof. The screen can comprise a loop sewn, welded, or both into both vertical edges and/or both horizontal edges.

The present system can further comprise vertical channels for securing the vertical edges of the screen. The vertical channels can be substantially C-shaped with a hem rod located inside the channel. In some embodiments, the vertical channels can have multiple pieces to facilitate assembly and installation. The loops in the vertical sides of the screen can encircle the hem rod such that the screen is both guided inside the channel, when being deployed or retracted, and retained in the channel when the screen encounters wind pressure or other forces. The hem rod acts to locate and secure the screen in substantially the same manner as a conventional hem cord, while significantly reducing storage requirements for the screen when retracted.

In some embodiments, the system can be installed on the outside of a building penetration, such as for example and not limitation, a door or a window. In this configuration, the system can also protect the door or window from solar heat gain, insect or pest infiltration, and thermal loss, in addition to storm and water damage. In some embodiments, the system can be installed on the inside of a building penetration. In this configuration, the system can provide the same protections for the building, and, for example, limited protection for the door or window. In some embodiments, the system can provide a light control layer to reduce or eliminate light infiltration into the building (e.g., the system can act as a "black-out" shade).

In some embodiments, the system can be mounted in the upper portion of a penetration and deployed from the top down (as used herein, the "top-down configuration") and can be manually or electrically deployed. In other embodiments, the system can be mounted in the bottom end of a penetration and deployed from the bottom up (as used herein, the "bottom-up configuration") and can be electrically or manually deployed.

The system can further comprise a horizontal support unit. The horizontal support unit can span all, or substantially all, of the free horizontal edge of the screen (i.e., the end of the screen not attached to the take-up roll). In some embodiments, such as when the top-down configuration is used, the horizontal support unit can be weighted and can facilitate the deployment of the screen. In other embodiments, such as when the bottom-up configuration is installed, the horizontal support unit can comprise a lightweight, rigid material. In some embodiments, the horizontal support unit can be attached to the screen using one or more horizontal loops in the screen. In other embodiments, the horizontal support unit can further comprise, for example and not limitation, latches, catches, or pins for securing the screen in the deployed, or partially deployed, position. In some embodiments, the horizontal support unit can further comprise a guide, molded or attached to the horizontal support unit, and sized and shaped to travel in the slot in the vertical channels.

Embodiments of the present invention can also comprise a method for installing the system on a penetration. The method can comprise affixing one or more C-shaped channels on the sides of the building penetration. An enclosure can then be installed in the top of the penetration enabling a top-down configuration. In other embodiments, the enclosure can be installed in the bottom of the penetration enabling a bottom-up configuration. A screen comprising a horizontal support bar can then be installed to protect the penetration. The method can further comprise installing a manual or electric drive system. In some embodiments, the system can be modular enabling the system to be installed in three main components.

These and other objects, features and advantages of the present invention will become more apparent upon reading the following specification in conjunction with the accompanying drawing figures.

DETAILED DESCRIPTION OF THE INVENTION

Embodiments of the present invention relate generally to storm protection systems and more specifically to a flexible, retractable storm protection system with a reduced storage volume and increased protection than have been conventionally provided. The system replaces a conventional hem cord design with a stationary hem rod located in a retention channel to provide the security of the hem cord system with the compact size of a hem-only system. The system can employ a retention channel with a hem rod disposed therein. The screen can have a loop sewn, welded, or otherwise manufactured into each vertical edge sized to easily slip over the hem rod. The hem rod can retain the screen in the retention track even when exposed to, for example, high wind, driving rain, and/or impacts from flying objects.

To simplify and clarify explanation, the system is described below as a system for protecting the windows and doors of residential and commercial buildings. One skilled in the art will recognize, however, that the invention is not so limited. The system can also be deployed to protect many penetrations in most structures during inclement weather or other environmental or man-made threats. The system can also be deployed to reduce or eliminate ("black-out") light infiltration into the building.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

A problem with conventional storm protection systems has been that the housings required to store the screens for these systems when not in use are undesirably large. The relatively large enclosure for the Armor Screen® Hurricane Protection System by the Armor Screen Corporation, for example, is dictated by the fact that the relatively thick, stiff hem cord product sewn onto the edges of the screen requires that a material be wound on approximately a 6" diameter take-up device. The large size of the take-up device is due predominantly to the stiff nature of the hem cord installed in the polypropylene screen material used by Armor Screen®. This hem cord is what guides the screen down each side of the door or window opening and secures the screen in a retention channel on both sides.

Figure 1A:
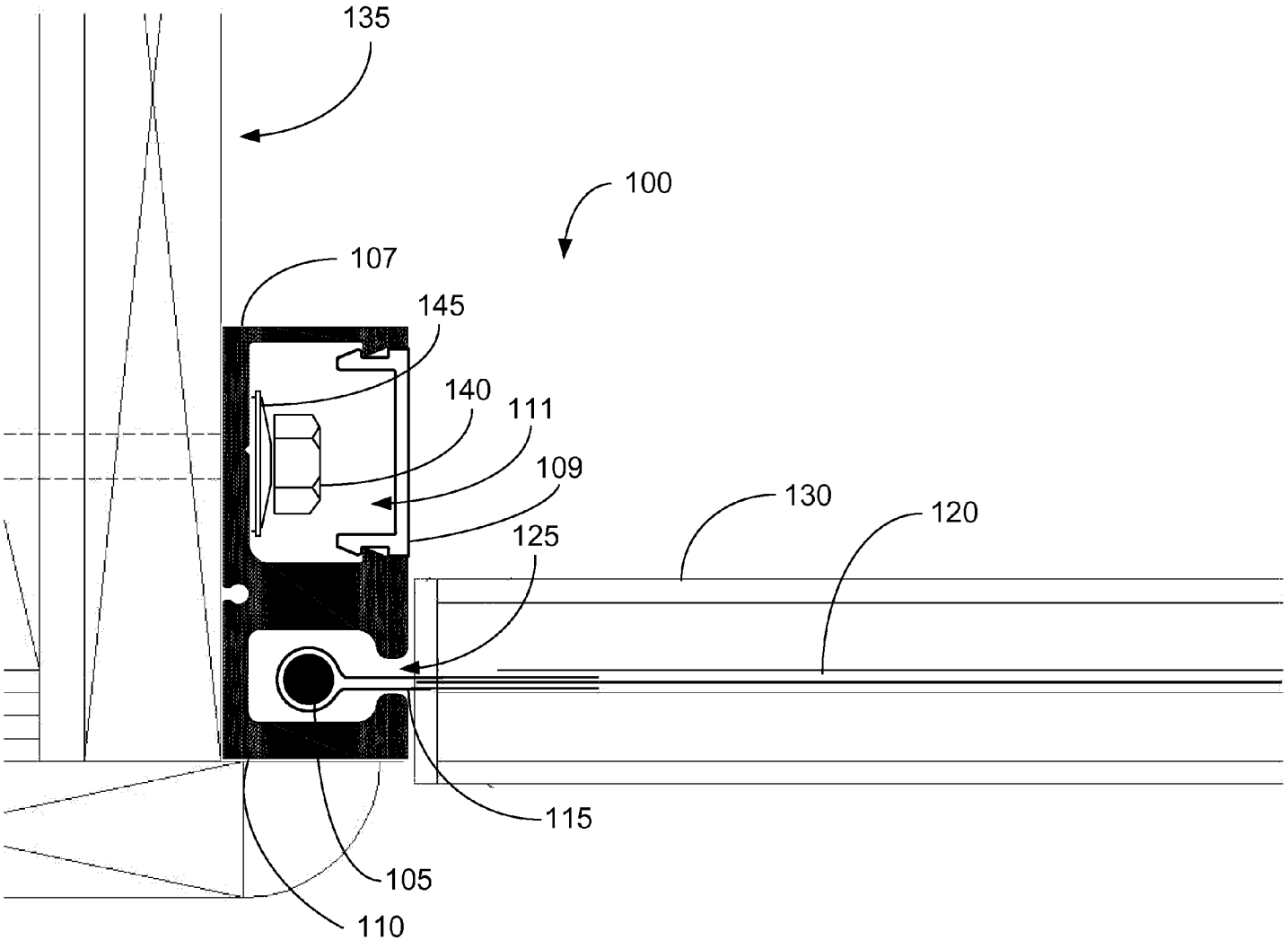
FIG. 1*a* depicts a top, detailed view of a retention track and enclosure for a storm shield system, in accordance with some embodiments of the present invention.
Figure 1B:
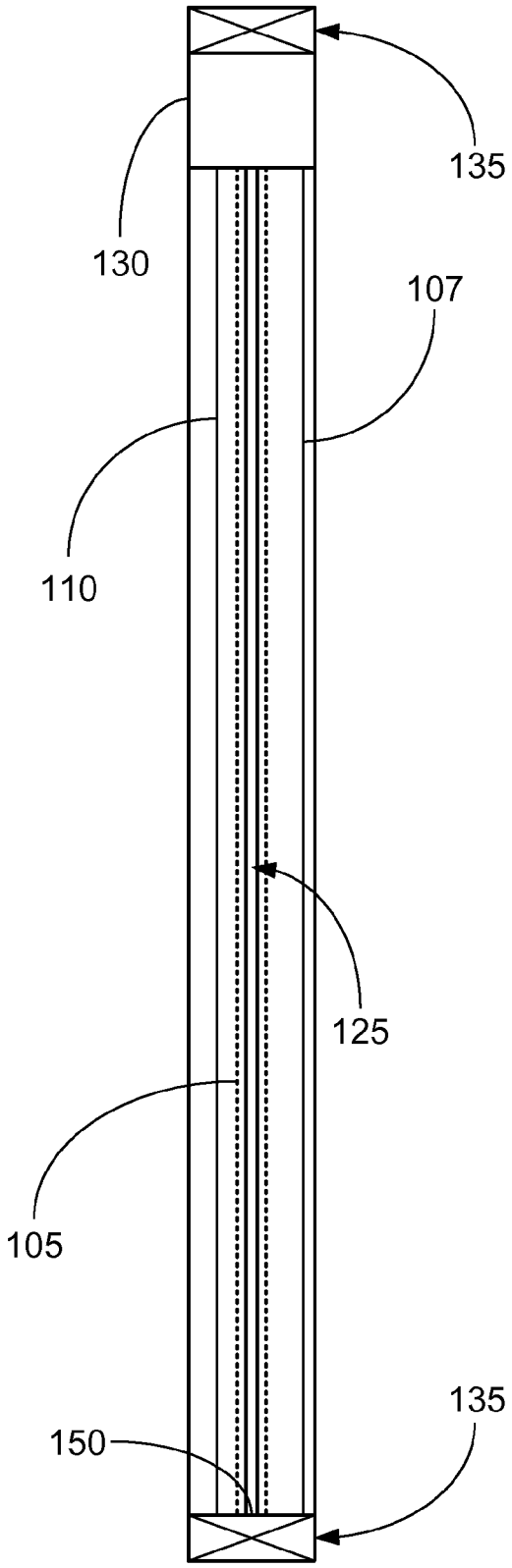
FIG. 1*b* depicts a side view of a retention track and enclosure for a storm shield system, in accordance with some embodiments of the present invention.

In response, as shown in FIGS. 1*a* and 1*b*, embodiments of the present invention relate to a system 100 in which the traditional rope bolt, or hem cord, can be replaced by inserting a side support unit 107 comprising a fixed rod 105 inside a C-channel extrusion 110. A loop 115 can then be sewn, welded, or both (hereinafter, "sewn") into the vertical sides of the screen 120 to slide down the rod 105 and can secure the fabric inside the extrusions 110. With the hem cord removed from the screen 120, the material can be flexible enough to be wound onto, for example and not limitation, a 2" diameter take-up device.

The hem rod 105 (as opposed to a hem cord) can enable a storage and deployment mechanism 100 that is approximately 50-60% smaller than conventional systems while containing approximately 45-55% greater vertical length of material. The result is a compact enclosure 130 that can, for example, contain approximately 100 vertical inches of screen in a box 130 that is significantly smaller (e.g., approximately 4"×5"). For comparison, the smallest Armor Screen® box is 7"×7" and accommodates a maximum of 68 vertical inches of screen. The smaller enclosure 130 can ease installation and reduce the aesthetic impact of the system 100 on the installation site. Space savings are maintained or improved as the size of the system increases, e.g., to protect larger openings.

Various materials, and combinations of materials, can be used to construct the protection screen 120. The screen 120 can provide, for example and not limitation, solar, insect, thermal, and storm ("SITS") mitigation attributes. The screen 120 can comprise a material that meets local, national, or international hurricane, building, and safety codes.

In some embodiments, the screen 120 can be deployed using an extrusion 110, e.g., an extruded C-channel 110, such that the loop 115 sewn, welded, or otherwise attached to, the screen 120 can be slid down a hem rod 105 mounted inside the channel 110. In this configuration, the loop 115 in the screen 120 can slide down over the hem rod 105 and can be retained in the slot 125 of the channel 110 by the hem rod 105. In other words, the present hem rod 105 replaces the hem cord or similar material used in commercially-available hem cord-type products. The channel 110 can be extruded, formed, machined, or fabricated as a single or multi-piece device. The hem rod 105 can be retained at a first end 150 of the channel, e.g., the end 150 in which the screen is considered fully deployed.

When the box 130 is mounted in the top of an opening 135 and the screen 120 is vertically deployed downwardly, for example, the hem rod 105 can be anchored at the bottom end 130 of the channel 110. The hem rod 105 can be made from many materials that enable it to stand vertically without support. The rod 105 can be made from, for example and not limitation, metal, plastic, fiberglass, composite material, wood, or combinations thereof. The diameter of the rod 105 can be sufficiently larger than the slot 125 in the channel 110 such that the material 120 cannot be pulled through the slot 125.

In some embodiments, the side support unit 107 can comprise a cover 109. As shown, the cover 109 can be snapped in to the side support unit 107 and can provide a decorative outside appearance. The cover 109 can comprise the same material as the side support unit 107 or can comprise a different material. The cover 109 can comprise, for example and not limitation, plastic, nylon, or aluminum. Although shown as a snap-in unit, in some embodiments it may be desirable for the cover to be hinged, tethered, or otherwise affixed to the side support unit 107. This can be useful, for example, when the system 100 is being installed or serviced in a high location (e.g., on a high rise building) to prevent the cover 109 from being dropped and causing injury and/or property damage below.

In some embodiments, the cover 109 and the side support unit 107 can define a compartment 111. The compartment 111 can be used to house system 100 components and/or spare parts such as, for example and not limitation, cables, pulleys, and fasteners. In other embodiments, various system 100 components can be placed in the compartment 111 at the factory for transportation to the installation site.

Figure 2A:
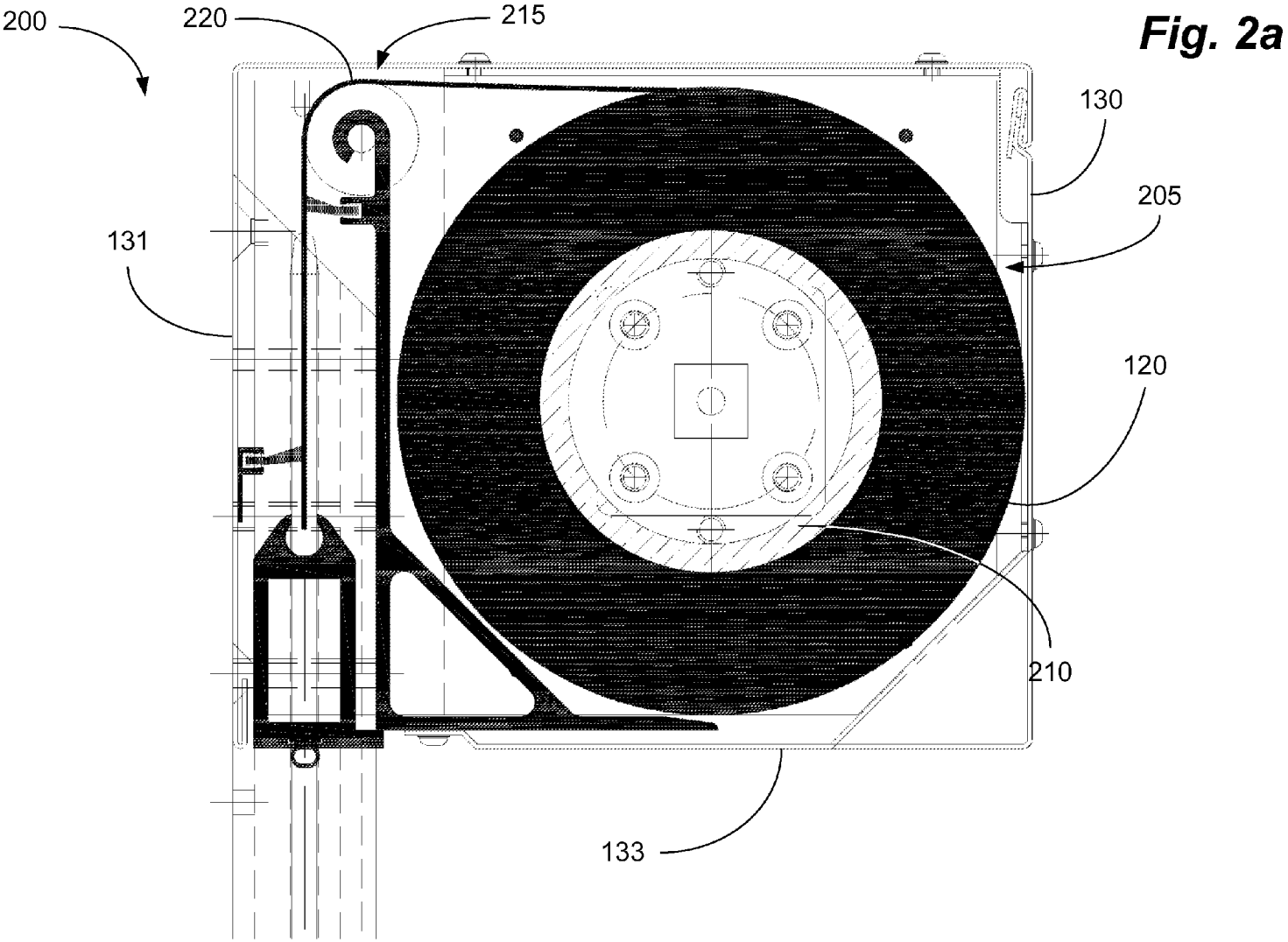
FIG. 2*a* depicts a cross-sectional view of an enclosure for a storm shield system with a roller-type deflector, in accordance with some embodiments of the present invention.
Figure 2B:
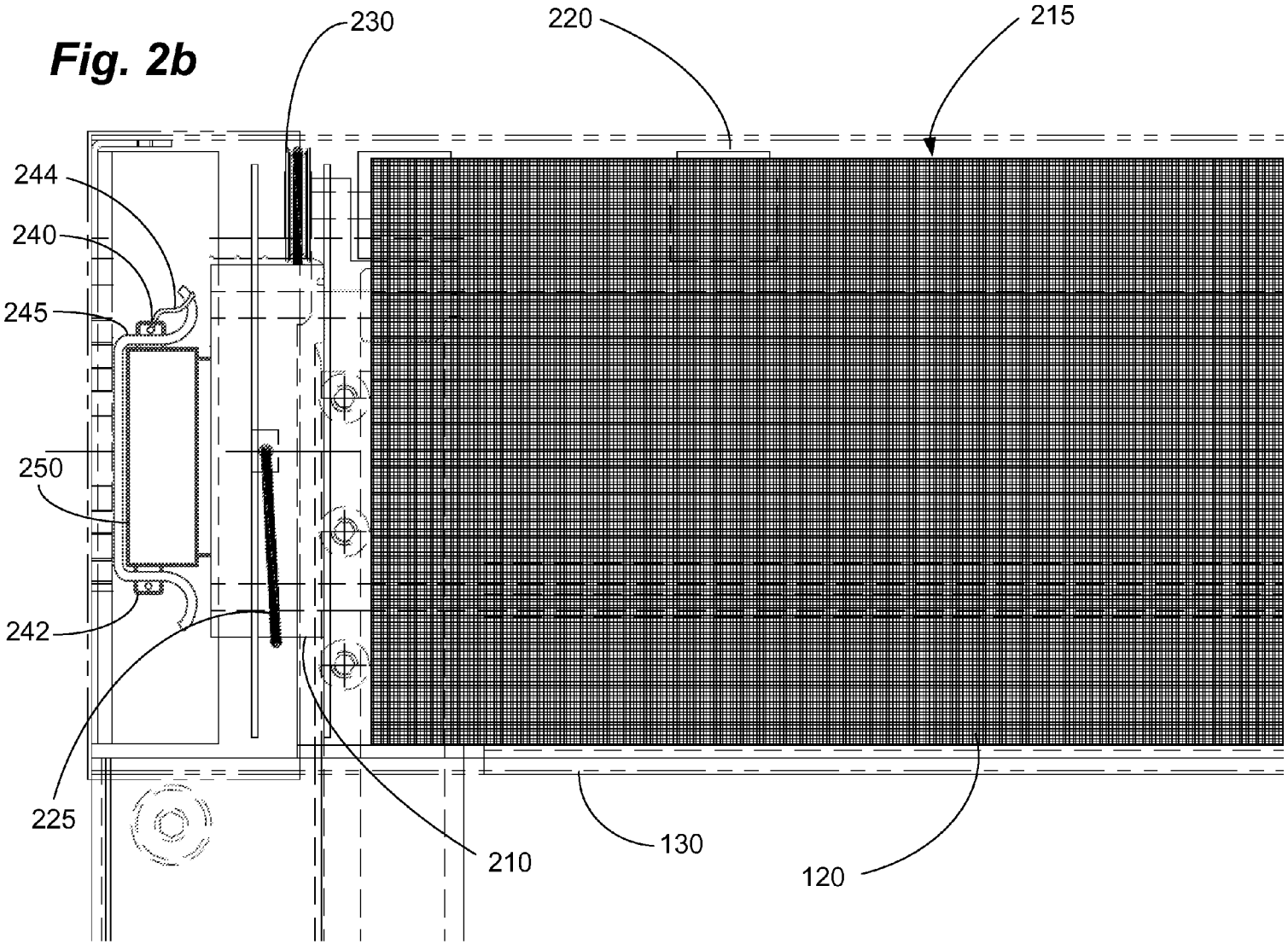
FIG. 2*b* depicts a cross-sectional view of the enclosure and motor system for the storm shield system with a roller-type deflector, in accordance with some embodiments of the present invention.
Figure 3:
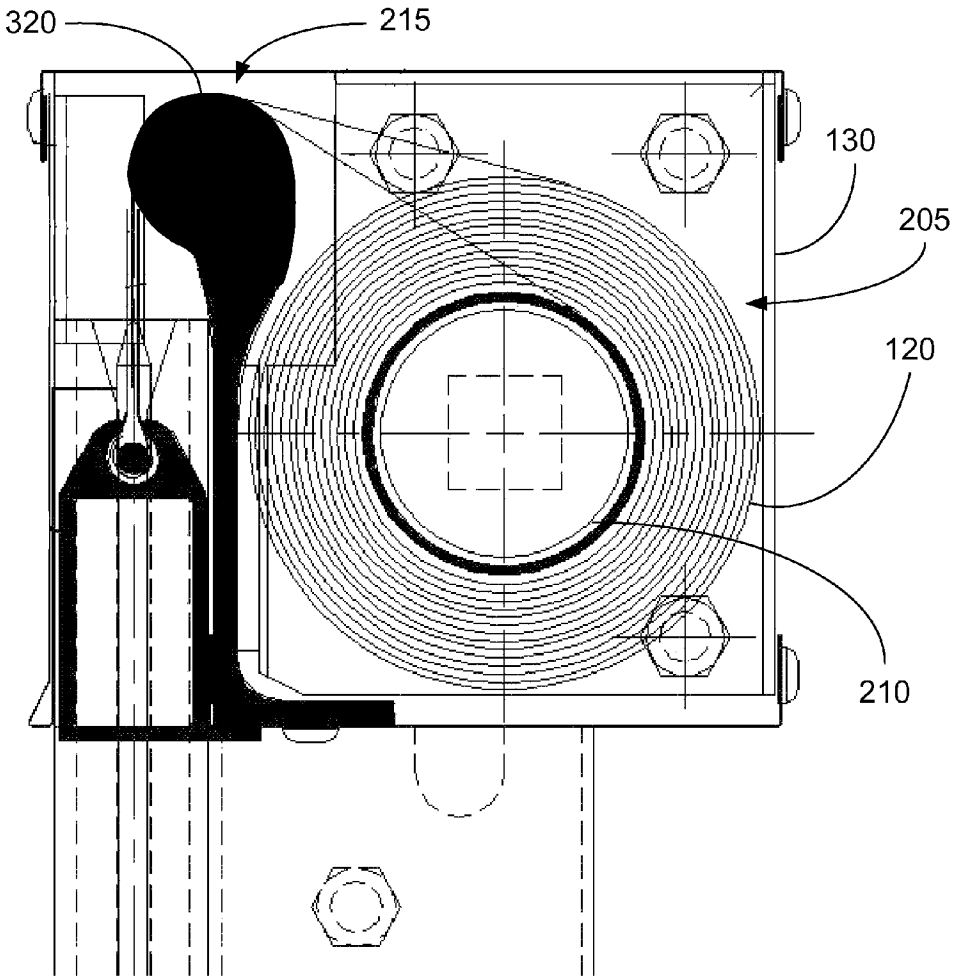
FIG. 3 depicts a cross-sectional view of the enclosure for the storm shield system with a smooth-type deflector, in accordance with some embodiments of the present invention.

As shown in FIGS. 2*a*, 2*b*, and 3, the screen 120 can be wound onto a take-up cylinder 210 for storage. The take-up cylinder 210 can be rotated by, for example and not limitation, an electric motor 250 coupled to the cylinder 210, a powered or manual end-mounted gear drive, or by a spring type device. A combination of one or more of these devices can also be utilized within a single operating unit to facilitate both powered and manual operation. This feature can be useful if, for example, the power to the building is interrupted. A spring, such as a torsional spring for example, can be added to provide assistance to the electric motor 250 or manual gear drive. These driving mechanisms can be utilized when the screen 120 is deployed in the top-down configuration or the bottom-up configuration.

In some embodiments, the motor 250 can be mounted inside the enclosure 130 using a mounting bracket 245. In some embodiments, the motor 250 can comprise one or more mounting tabs 242 and can be coupled to the bracket 245 using a pin 240 or other suitable means. The pin 240 can be, for example and not limitation, a cotter pin, a clevis pin, a bolt, or a screw. This configuration can enable the motor 250 to be efficiently installed and removed during, for example, assembly or repair of the system 200. Of course, other mounting systems can be employed and are contemplated herein.

In some embodiments, the deployment mechanism 205 can comprise a deflector 215. The deflector 215 can enable the material of the screen 120 to be deployed or retracted vertically such that the angle of the screen 120 is substantially constant, regardless of the length of screen 120 on the take-up roll 210 (i.e., the diameter of the take-up roll 210 increases as the screen 120 is retracted). In other words, the deflector 215 ensures that the material 120 is always deployed such that the angle of entry or exit from the enclosure 130 is substantially vertical. The deflector 215 can comprise many appropriate systems including, but not limited to, one or more rollers 220 (FIGS. 2*a* and 2*b*) or a smooth, rounded surface or profile 320 (FIG. 3). In some embodiments, the deflector 215 can further comprise non-friction or other coatings to facilitate screen 120 deployment. The deflector 215 enables the size of the box 130 to be further reduced by smoothly, but sharply, turning the screen 120 from the roll 210 to a vertical position. This enables the screen 120 to turn through a much larger angle than would otherwise be possible without damaging or tangling the fabric.

In some embodiments, as shown in FIG. 2*a*, the enclosure 130 itself can comprise one or more pieces. In a preferred embodiment, the enclosure can comprise two L-shaped components 131, 133. This system 200 can comprise a mount 131 and a cover 133. The mount 131 can provide a mounting surface for various system 200 components. The cover 133, on the other hand, can be removable to enable access to internal system 200 components. When installed, the cover 133 can provide an attractive appearance for the enclosure 130 and can be, for example, painted to match or complement the existing structure. As shown, the cover 133 can be snapped into the mount 131 using an s-type bend, or can be attached using other suitable means such as, for example and not limitation, bolts, screws, or adhesive. In other embodiments, the cover 133 can be hingeably affixed to the mount 131 or can be tethered to the mount 131 to enable the cover 133 to be removed, but not dropped. See, e.g., FIG. 14.

In still other embodiments, as shown in FIG. 2*b*, the take-up roll 210 and the deflector 215 can be mechanically coupled using a cord 225. The cord 225 can be a bungee cord, chain, rope, spring, or other suitable material. The cord 225 can be connected to the take-up roll 210 and, for example and not limitation, a pulley 230 on the deflector 215. In this manner, when the take-up roll 210 turns (e.g., is driven with a motor drive 250) the rollers 220 on the deflector 215 can be positively rotated. This can provide additional driving force to aid in the positive deployment and retraction of the screen 120. In other embodiments, the cord 225 can be further connected to a pulley drive system, as discussed below. See, e.g., FIGS. 7*a*-7*b*.

Figure 4:
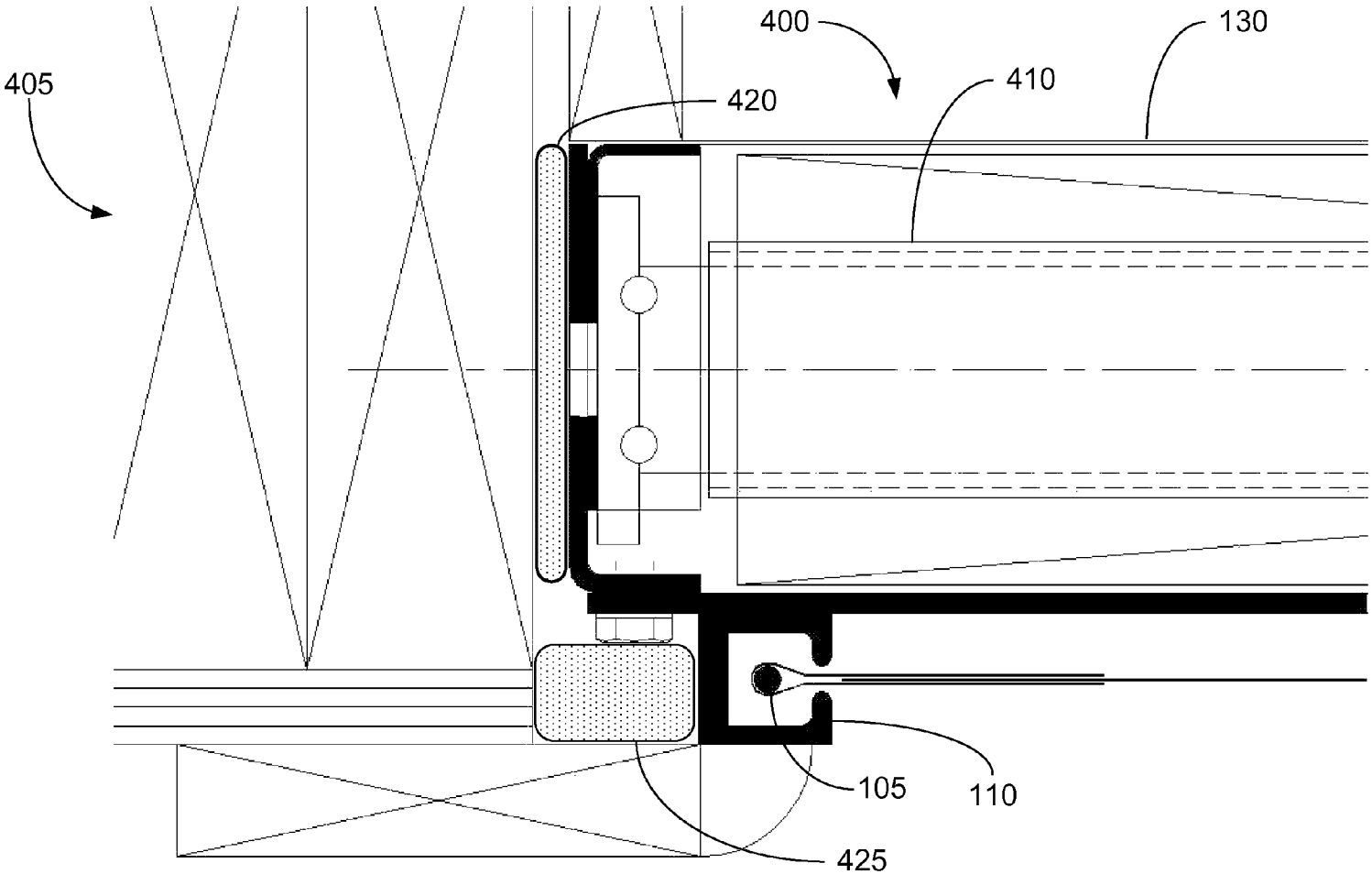
FIG. 4 depicts a detailed view of the enclosure and retention track installed in a trapped configuration, in accordance with some embodiments of the present invention.
Figure 5:
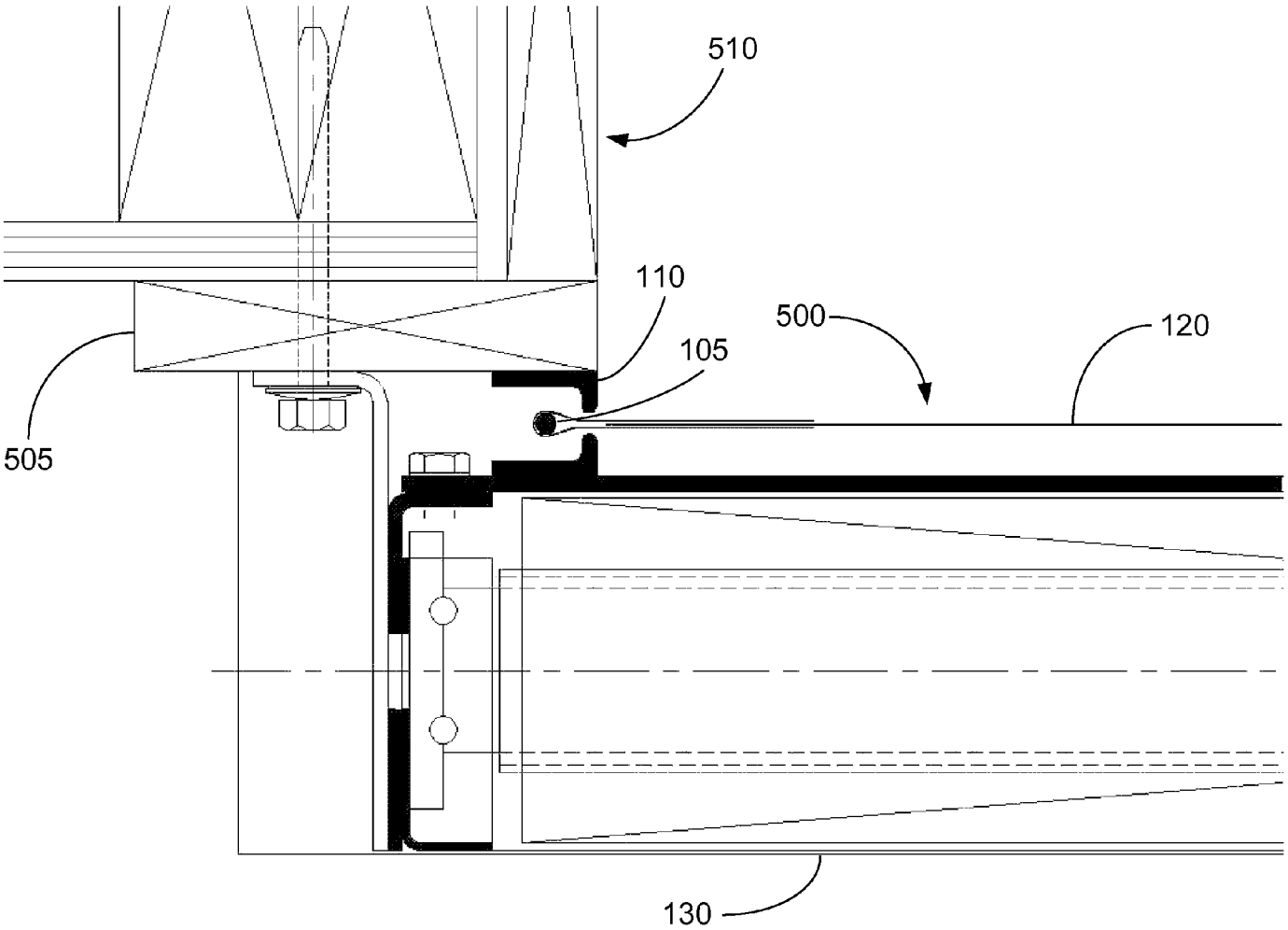
FIG. 5 depicts a detailed view of the enclosure and retention track installed in a face-mounted configuration, in accordance with some embodiments of the present invention.

As shown in FIGS. 4 and 5, the system 400, 500 can be utilized in both a trapped configuration 400 and a face-mounted configuration 500, respectively. A trapped configuration 400 can be installed inside a window or door opening 405 with the take up mechanism 410 and retention mechanisms 105, 110 all being located within the opening 405. The face-mounted installation 500, on the other hand, can be attached to the outside surface, or trim 505, of the opening 510. Both the trapped 400 and face-mounted 500 units can be operated either with the box 130 on the top with the screen 120 going down (the "top-down configuration") or the box 130 mounted on the bottom with the screen 120 going up (the "bottom-up configuration").

As shown in FIG. 4, a trap-mounted unit 400 is installed inside and at the top or bottom of a window or door opening 405, for example, with the vertical extrusions 110 containing the hem rod 105 mounted inside the opening 405. As shown in FIG. 5, a face-mounted unit 500 is attached on the trim 505 above or below and outside the opening 510 with the extrusions 110 containing the fixed hem rod 105 mounted on the vertical trim 505 outside the opening 510. Both of these installations can be made architecturally discreet and can be installed in a variety of ways that reduce, or eliminate, their visual impact on the structure. In the case of the new construction, the trap-mounted system 400 allows for the box 130 and extrusions 110 to be built into the window or door opening 405 in such a way that they are virtually indistinguishable from a regular opening.

The system 400, 500 can also be installed on the inside or the outside of the opening. In other words, it can be installed in front of, or behind, the window or door. When installed on the outside of the window or door, the system 400, 500 can provide additional protection against, among other things, storm damage caused by wind, wind driven missiles, and driving rain. The system 400, 500 can also help reduce solar heat gain, thermal losses, and insect and pest infiltration. In some embodiments, the system 400, 500 can also provide additional insulation value to the structure thereby reducing energy costs.

In some embodiments, the system 400, 500 can be installed inside of the window or door (i.e., inside the building). The system 400, 500 can provide the benefits listed above in this configuration, with the obvious exception of storm protection for the outside of the window or door itself. However, this configuration may be useful, for example and not limitation, with certain windows (e.g., casement windows) or out swinging doors. In addition, this configuration enables the screens to be easily operated from inside the building.

Figure 6A:
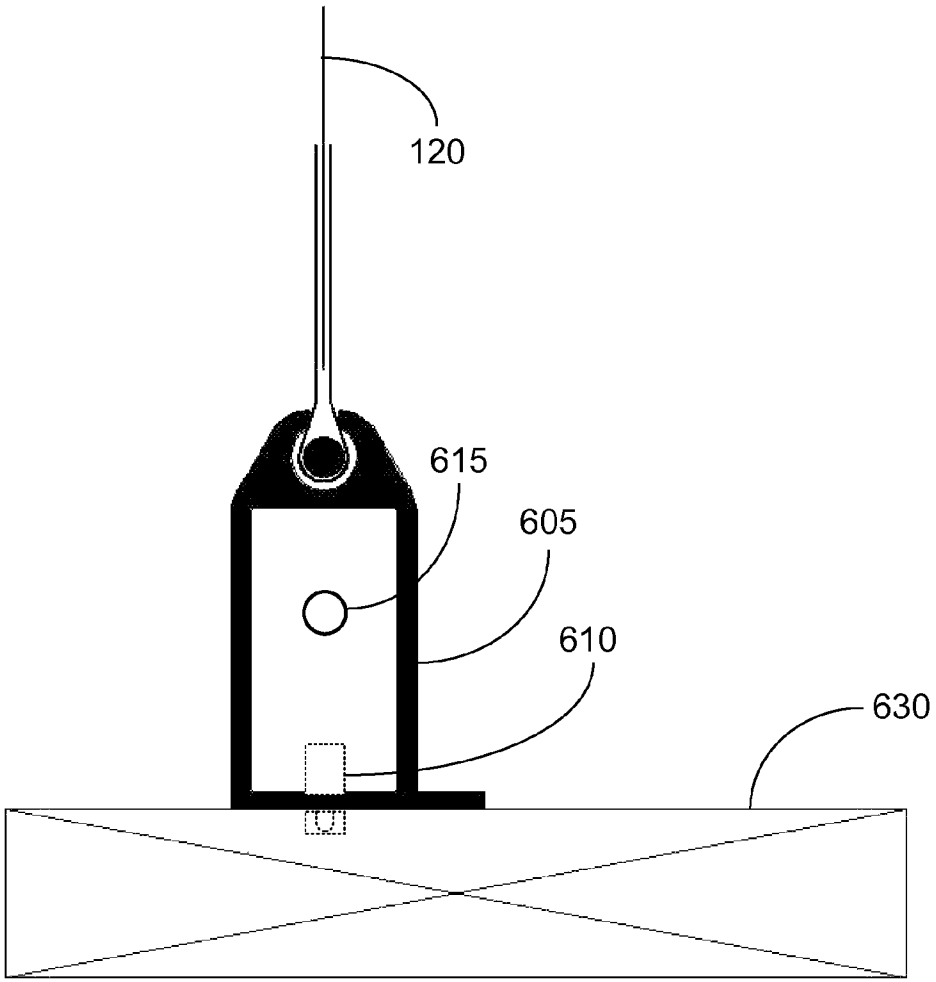
FIG. 6*a* depicts a side view of a screen and weight bar for the storm shield system, in accordance with some embodiments of the present invention.
Figure 6B:
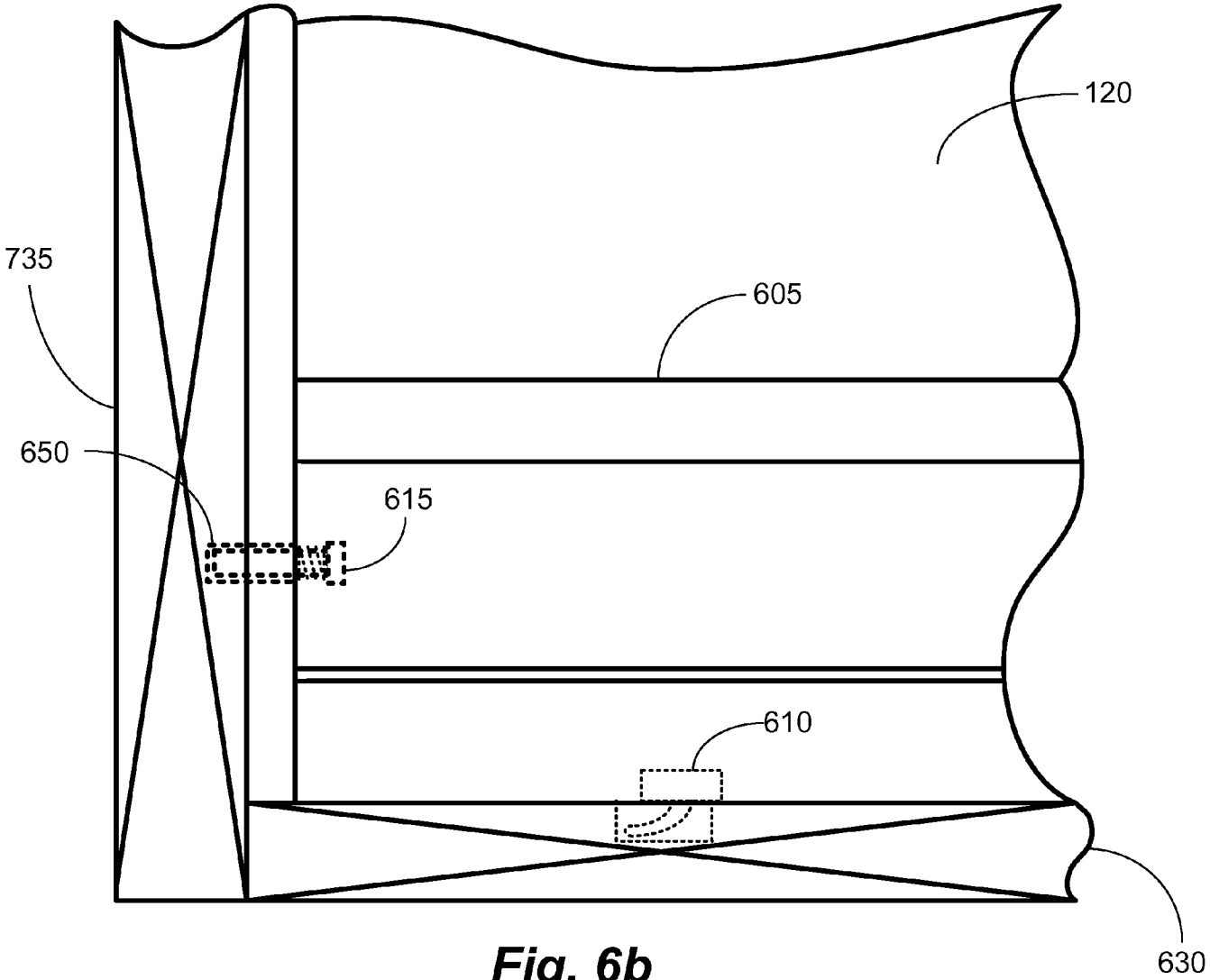
FIG. 6*b* depicts a detailed, front view of the screen and weight bar with a bottom lock and stop pin for the storm shield system, in accordance with some embodiments of the present invention.

As shown in FIGS. 6*a* and 6*b*, the system can further comprise a horizontal support unit 605. The horizontal support unit 605 can be attached to the free end of the screen 120 (i.e., opposite the end of the screen 120 that is attached to the take-up cylinder 410). When the screen 120 is fully retracted into the enclosure 130, the horizontal support unit 605 can either be fully retracted into the enclosure 130 or exposed just outside the enclosure 130. See, FIG. 9. The horizontal support unit 605 can be made of rigid materials such as, but not limited to, metal, plastic, fiberglass, composite material, wood or other compressed materials.

In some embodiments, the horizontal support unit 605 can contain weight to assist in the deployment of the screen 120. In other embodiments, the horizontal support unit 605 can comprise latching mechanisms 610, 615 to assist in securing the screen 120 in a variety of positions. In some embodiments, the horizontal support unit 605 can comprise locking latches 610 or pins 615 that enable the screen 120 to be secured in many positions between the fully deployed and the fully retracted position. In some embodiments, the latches 610 can, for example, engage a catch in the sill 630 of the opening. In other embodiments, pins 615 can be used to engage holes in the jamb(s) 735 of the opening. Of course, other configurations are contemplated as other mechanisms could be used to secure the horizontal support unit 605, for example, to the opening or the channels 110. The ability to secure the horizontal support unit 605 can be useful, for example, to let fresh air in through a partially open window and/or screen 120, while maintaining substantial protection for the opening 735.

Figure 6C:
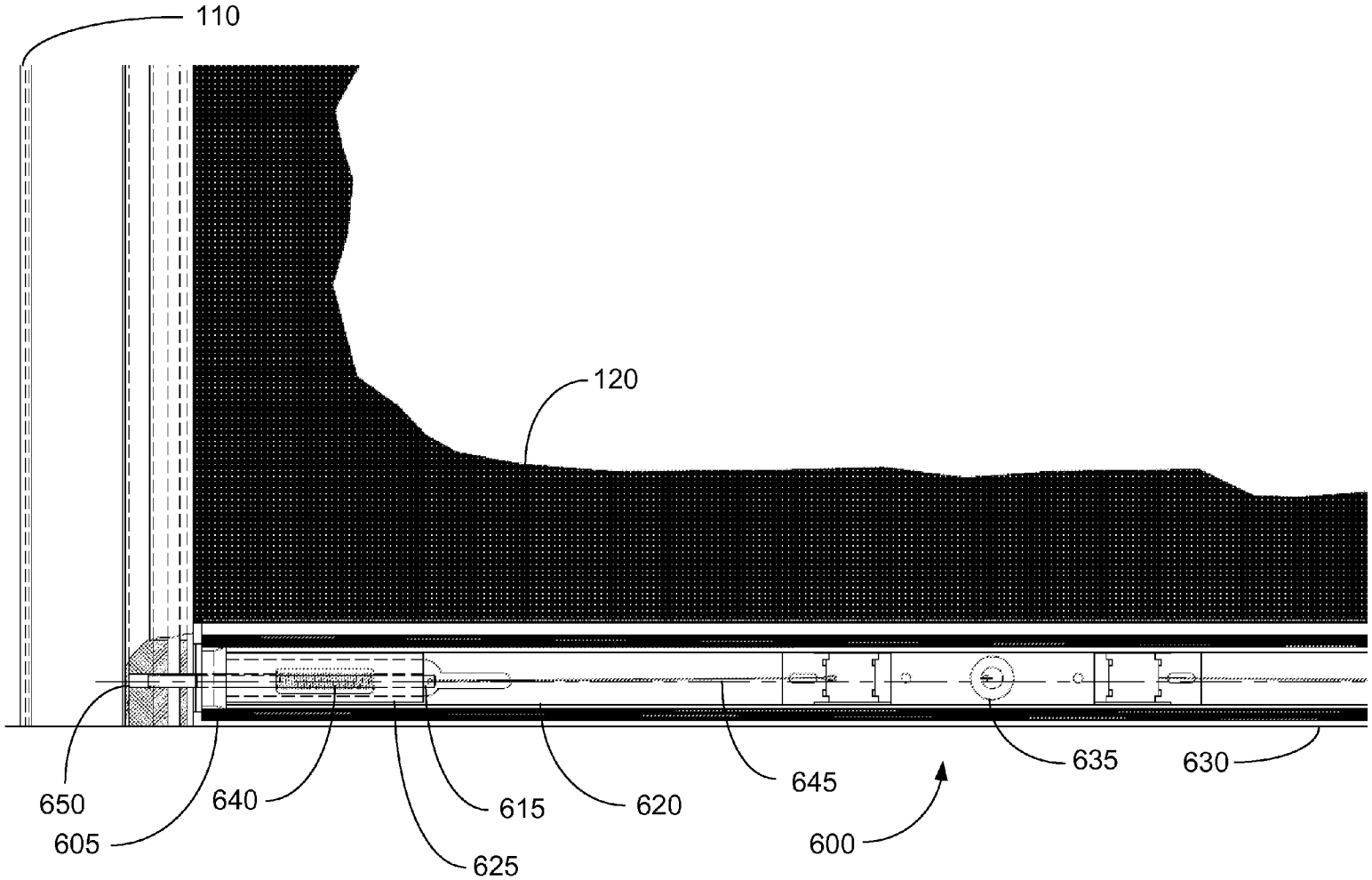
FIG. 6*c* depicts a detailed, cross-sectional view of the screen and weight bar with a bottom lock for the storm shield system, in accordance with some embodiments of the present invention.

In some embodiments, as shown in FIG. 6*c*, the horizontal support unit 605 can comprise a locking system 600 for securing the window. The locking system 600 can comprise a lock 635 disposed in the horizontal support unit 605. The lock 635 can be connected to the locking pin 615 via one or more cables 645. In this configuration, a centrally located lock 635 can operate a locking pin 615 at either end of the horizontal support unit 605. In some embodiments, the locking pin 615 can further comprise a return spring 640. The return spring 640 can ensure that the normal position for the locking pin 615 is extended (e.g., locked). In this manner, the locking pin 615 can be retracted to move the window, for example, by turning the lock 635. When the lock 635 is released, however, the locking pin 615, driven by the spring 640 can automatically return to the extended position (i.e., the position in which the window is locked).

In some embodiments, a locking bar extrusion 620 can house the locking system 600. The locking bar extrusion 620 can be disposed inside the horizontal support unit 605 and sized and shape to house the spring 640 and pin 615. The locking bar extrusion 620 can retain the components 615, 635, 640, 645 of the locking system 600. In some embodiments, the locking system 600 can further comprise a locking guide 625, disposed in the locking bar extrusion 620, to maintain the alignment of the locking pin 615. In some embodiments, the locking system 600 can be preassembled in the locking bar extrusion 620 and then locking bar extrusion 620 can be installed in the horizontal support unit 605 to facilitate manufacturing. The locking bar extrusion 620 can also increase the modularity of the system 400, 500 enabling multiple, or no, locking system 600 to be chosen during assembly to meet customer needs.

Figure 6F:
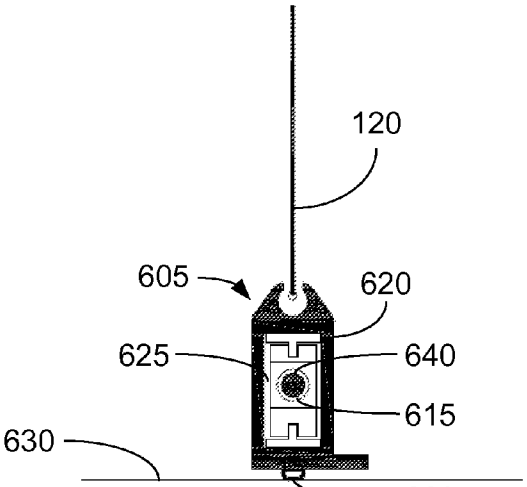
FIG. 6*f* depicts a detailed, cross-sectional view of the end of the weight bar and the locking pin mechanism for the storm shield system, in accordance with some embodiments of the present invention.
Figure 6E:
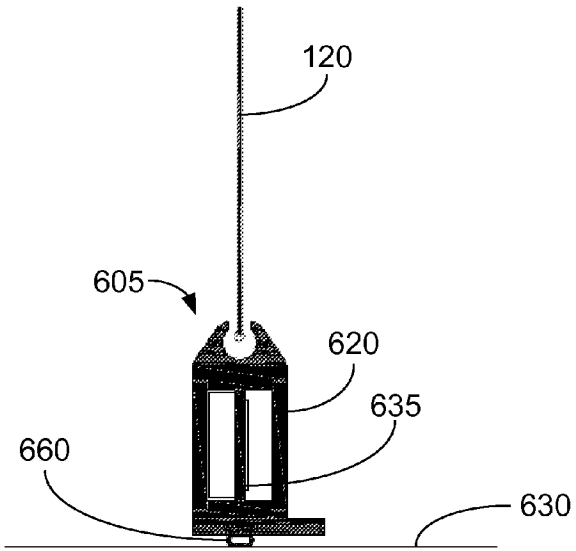
FIG. 6*e* depicts a detailed, cross-sectional front view of the weight bar and the lock mechanism for the storm shield system, in accordance with some embodiments of the present invention.
Figure 6D:
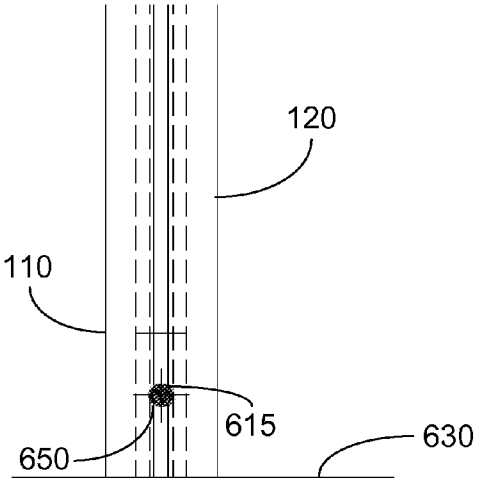
FIG. 6*d* depicts a detailed, cross-sectional view of the retention channel and locking pin hole for the storm shield system, in accordance with some embodiments of the present invention.

As shown in FIG. 6*d*, in some embodiments, the retention channels 110 can further comprise one or more holes 650 to receive the locking pin(s) 615. In some embodiments, the channels 110 can comprise a plurality of holes along their length to enable the screen 120 to be locked in multiple positions. This can be useful to, for example, allow light or fresh air into the building.

FIGS. 6*e* and 6*f* depict detailed cross-sectional views of the horizontal support unit 605, in accordance with some embodiments of the present invention. The horizontal support unit 605 can comprise a locking bar extrusion 620 for housing the locking components. As shown, the locking bar extrusion 620 can comprise the locking pin 615 and spring 640. In some embodiments, these components 615, 640 can be housed in a locking guide 625 inside the locking bar extrusion 620. The locking guide 625 can comprise a retainer for the locking pin 615 and spring 640 and can maintain the alignment of the locking pin 615 in use.

In some cases, it may be desirable for the locking system 600 to include a lock 635 and key. This can be desirable, for example, to maintain security, to prevent screen 120 movement during high winds, or to prevent children from moving the screen 120. As shown in FIG. 6*e*, therefore, the locking bar extrusion 620 can further comprise a lock 635. In some embodiments, the lock 635 can be in communication with the locking pin 615 via, for example and not limitation, a cable, a chain, or a rod. This can enable the lock 635 to be located in the center of the horizontal support unit 605 and be connected to one or more locking pins 615 (e.g., one pin 615 at each end). In an alternative embodiment, the lock 635 can be located such that it is in direct communication with the locking pin 615 (e.g., one lock at each locking pin 615 location). Of course, other suitable levers or locking mechanisms could be used and are contemplate herein.

The horizontal support unit 605 can further comprise a seal, or gasket 660. In some embodiments, the gasket 660 can span most, or all, of the bottom of the horizontal support unit 605. In other embodiments, the gasket 660 can extend up one or more sides of the horizontal support unit 605. The gasket 660 can prevent air and water infiltration under and around the horizontal support unit 605. The gasket 660 can also provide quiet closing of the screen 120 as the gasket 660 prevents the horizontal support unit 605 from directly touching the sill 630 and cushions the contact therebetween. In other embodiments, the horizontal support unit 605 may seat in an L-channel or a U-channel installed on the sill 630 of the window. In this configuration, the horizontal support unit 605 may have gaskets on up to three sides (e.g., the bottom and both sides).

Figure 6G:
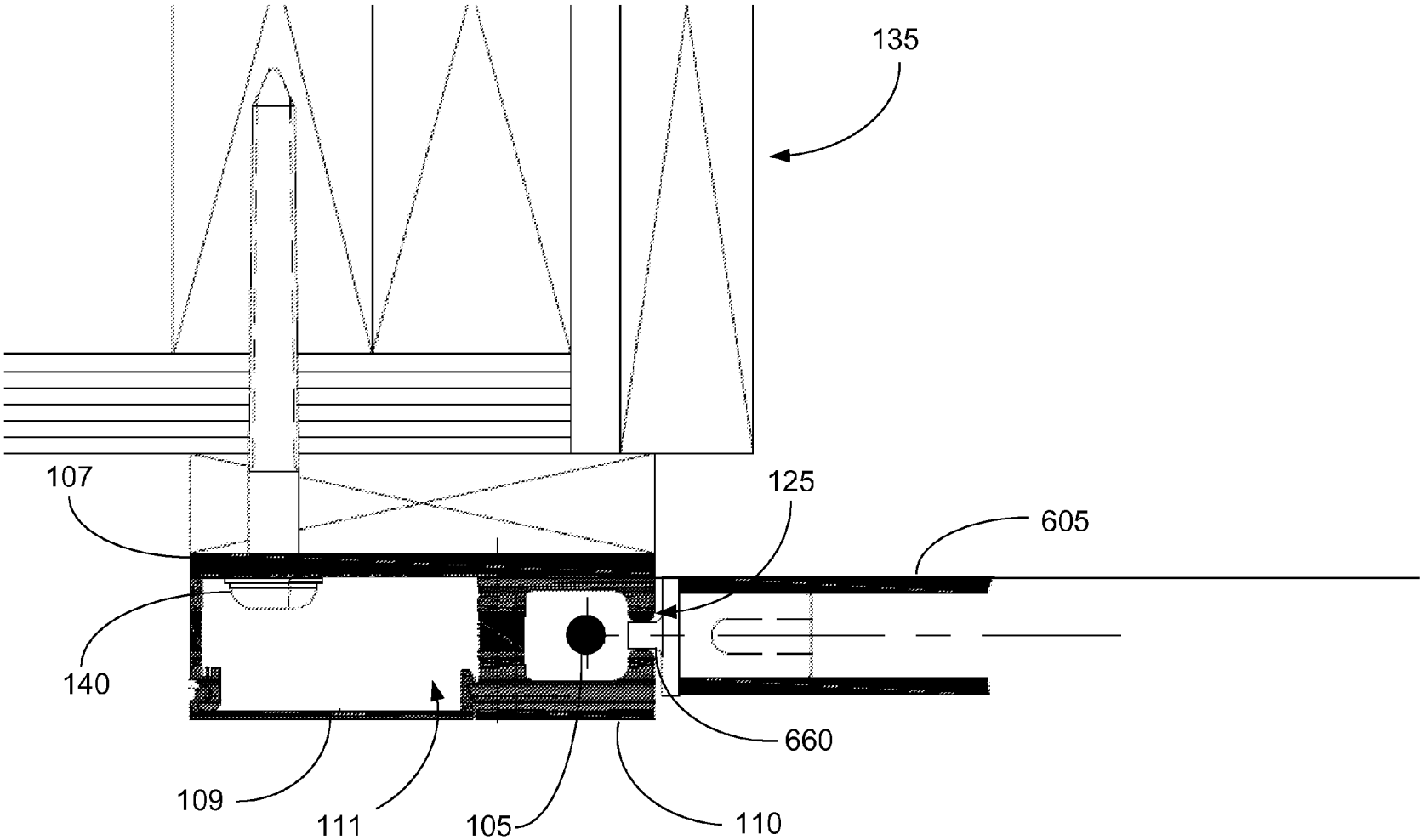
FIG. 6*g* depicts a top view of the retention channel and weight bar with guide for the storm shield system, in accordance with some embodiments of the present invention.

As shown in FIG. 6*g*, in some embodiments, the horizontal support unit 605 can further comprise a guide 660. In some embodiments, the guide 660 can be sized and shaped to coincide with the slot 125 in the c-channel extrusion 110. In this configuration, the guide 660 can provide additional stability for the horizontal support unit 605 and the screen 120 as it is deployed and retracted. The guide 660 can be integral with the extrusion of the horizontal support unit 605 or can be attached separately. In some embodiments, the guide 660 can comprise a material with a low coefficient of friction with respect to the c-channel extrusion 110 such as, for example and not limitation, plastic, nylon, aluminum, or Teflon®.

Figure 6H:
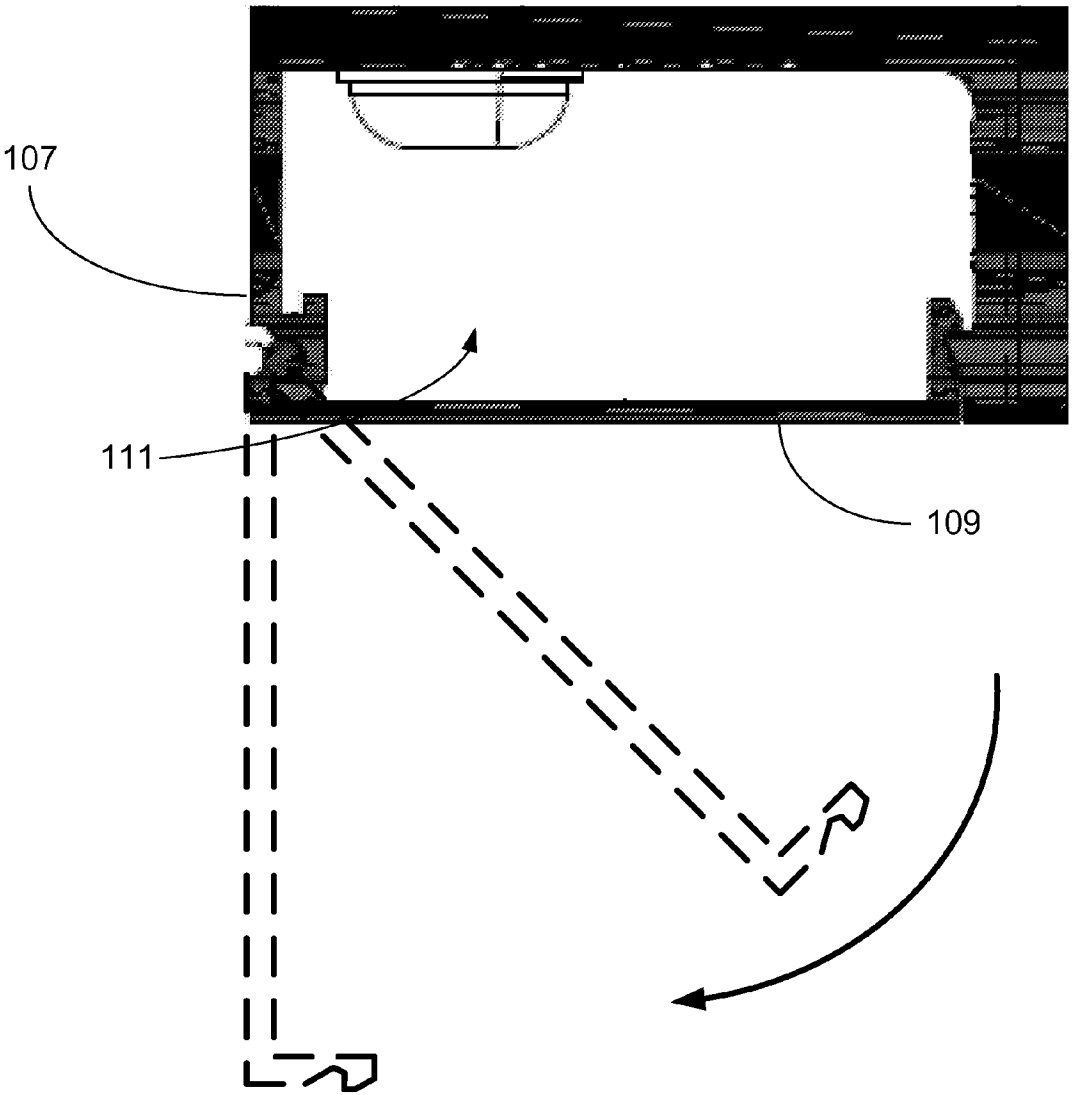
FIG. 6*h* depicts a top view of a side support unit for the storm shield system with a hinged cover, in accordance with some embodiments of the present invention.

In still other embodiments, shown in FIG. 6*g* and in detail in FIG. 6*h*, the side support unit 107 can comprise a cover 109. In some embodiments, the cover 109 can be hinged to the side support unit 107. In some embodiments, the cover 109 and the side support unit 107 can define a storage compartment 111. As mentioned above, the compartment 111 can provide space for spare parts and for various system components, such as cables and pulleys, discussed below. The compartment 111 can also provide access to various system components to enable the system to be serviced, repaired, and adjusted during use. The compartment 111 can enable system components to be hidden and provide a clean, aesthetic outward appearance. In some embodiments, the compartment 111 can be used to store various components during transportation to reduce transportation costs and facilitate installation.

Figure 7A:
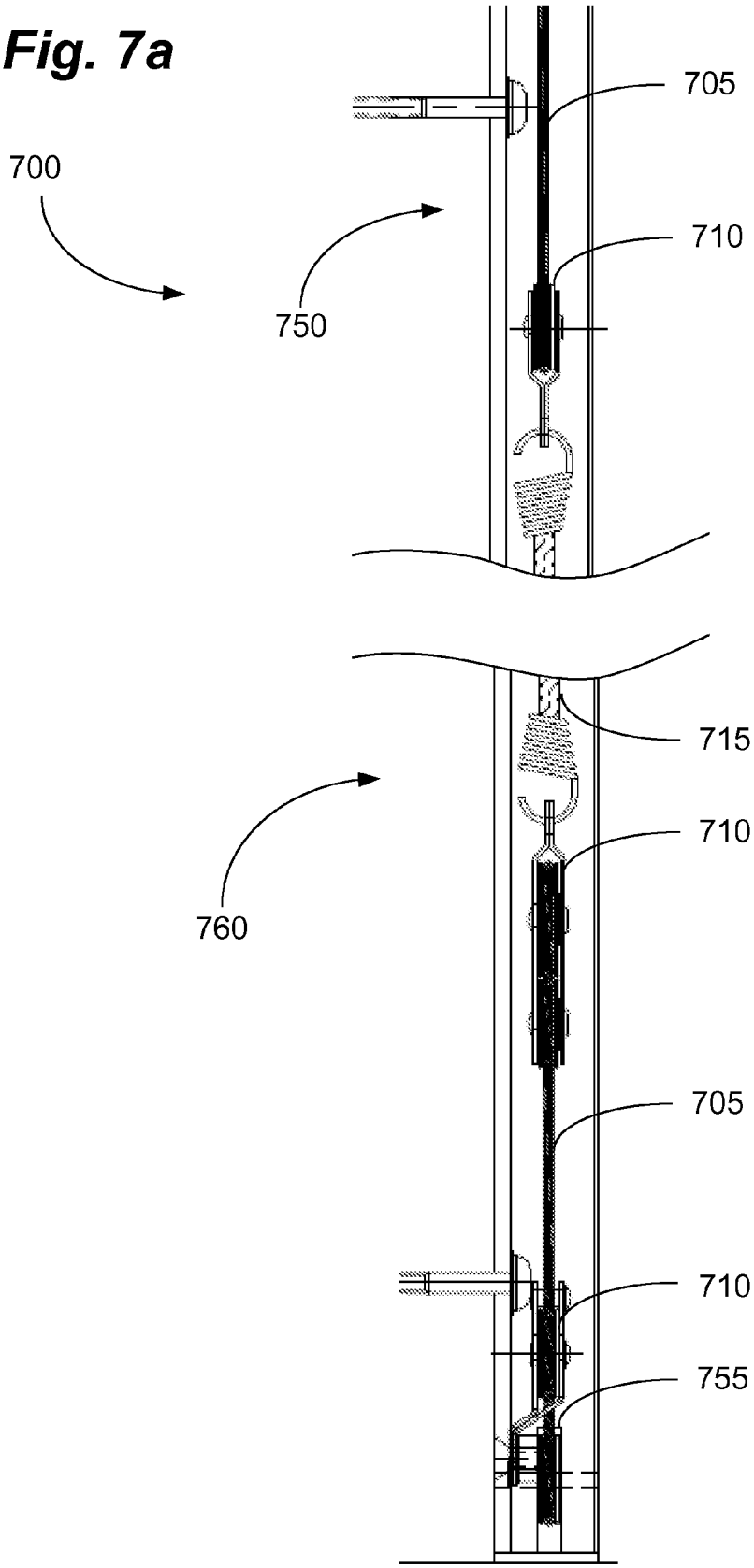
FIG. 7*a* depicts a side view of a cable deployment system for the storm shield system in the up position, in accordance with some embodiments of the present invention.
Figure 7B:
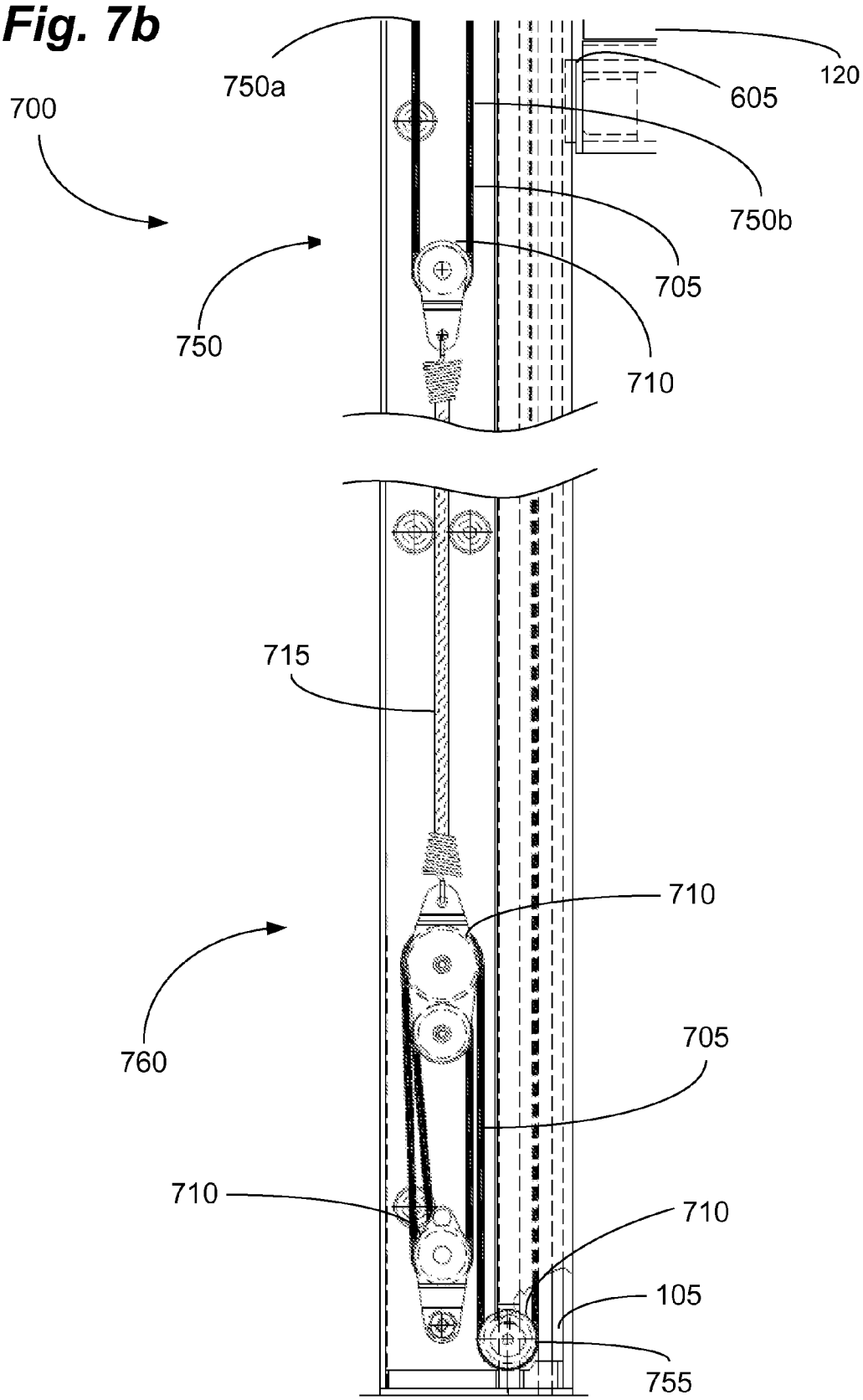
FIG. 7*b* depicts a front view of the cable deployment system for the storm shield system in the up position, in accordance with some embodiments of the present invention.

As shown in FIGS. 7*a* and 7*b*, in some embodiments, the system 400, 500 can further comprise a cable drive system 700 to positively deploy the screen 120. The cable system 700 can comprise, for example, a system of cables 705 and pulleys 710 to move the screen 120 and/or the horizontal support unit 605 up and down rather than relying solely on gravity. This can be useful, for example, during high winds, which tend to create side forces on the screen 120 that increase friction.

In some embodiments, the system 700 can comprise a tensioning means 715 to assist in lowering the screen 120. The tensioning means can comprise, for example and not limitation, bungee cords, rubber bands, elastic, or springs. When the screen 120 is in the retracted, or up, position (i.e., in a top-down installation), the tensioning means 715 can be in a substantially relaxed position. In this position, the tensioning means 715 can provide little or no force to the system 700 to enable the screen 120 and the horizontal support unit 605 to be stored in the retracted position.

The cable drive system 700 can comprise an upper pulley system 750 and a lower pulley system 760. The upper and lower pulley systems 750, 760 can comprise various pulleys 710, such that they provide a different "gear" ratio. In other words, as shown, the lower pulley system 760 has an additional set of pulleys 710 and an additional cable 705 winding, thus increasing its effective gearing. In a preferred embodiment, the upper cable system can provide a 2:1 gear ratio, while the lower pulley system 760 can provide a 4:1 gear ratio. As a result, as the screen 120 is deployed, both systems 750,760 move upward, but the lower pulley system 760 moves half the distance of the upper pulley system 750. This difference in displacement causes the tensioning means 715 to extend as the screen 120 is extended.

In a preferred embodiment, the cable 705 can travel through the lower pulley system 760, through a lowermost pulley 755, and then up to the screen 120. The cable 705 can then be sewn, welded, or otherwise attached to the side of the screen 120. In this configuration, as the screen 120 is deployed, the tensioning means 715 is extended between the two cable systems 750, 760, thus increasing the downward tension on the screen 120. This can enable the screen 120 to be lowered in high winds, despite increased side loading, and can help maintain the screen 120 in the deployed position (e.g., the system 700 can provide maximum downward tension on the screen 125 when it is deployed). Of course, a similar system could be used in reverse to assist in retracting the screen 120 (e.g., for particularly heavy or large screens).

Referring to FIGS. 2*b* and 7*b*, in other embodiments, the cable 705 can be the same as, or connected to, the cable 225 for the deflector 215. In other words, a first cable 750*a* for the upper cable drive 750 can be attached to a fixed point on, for example, the enclosure 130, while a second cable 750*b* can travel over the pulley 230 for the deflector 215 and wrap around and attach to the take-up roll 210. In this configuration, the upper cable drive system 750 can provide positive rotation on the deflector 215 improving screen 120 deployment. Of course, other cable configurations could be used and are contemplated herein.

The cable drive system 700 can be installed in systems 400, 500 of varying sizes to accommodate different sized openings. As a result, it can be useful to have a method to determine the length of the tensioning means 715. The tensioning means can have, for example, a free length (i.e., prior to installation), a pre-tensioned length (i.e., installed—screen up), and an extended length (i.e., installed—screen down). So, for example, if the tensioning means 715 is a bungee cord, the free length of the bungee cord 715 can be calculated using equation 1, the pre-tensioned length can be calculated using equation 2, and the extended length can be calculated using equation 3:

$$\text{Length (free)}=0.9*(\text{Screen Height}-10.25-(0.5*\text{Screen Height})) \quad \text{(Eq. 1)}$$

$$\text{Length (pre-tensioned)}=\text{Screen Height}-10.25-(0.5*\text{Screen Height})) \quad \text{(Eq. 2)}$$

$$\text{Length (extended)}=\text{pre-tensioned length}+(\text{Screen Height}/4) \quad \text{(Eq. 3)}$$

These calculations can enable the length of the tensioning means 715 to be calculated prior to installation to prevent unnecessary trial and error. This can be useful because the cable system can generally be installed inside, or in a compartment adjacent to, the retention channels 110 during manufacture. If the screen is, for example 66 inches tall the calculations yield:

$$\text{Length (free)}=0.9*(66''-10.25''-(0.5*66''))=20.48'' \quad \text{(Eq. 1)}$$

$$\text{Length (pre-tensioned)}=66''-10.25''-(0.5*66''))=22.75'' \quad \text{(Eq. 2)}$$

$$\text{Length (extended)}=22.75''+(66''/4)=39.25'' \quad \text{(Eq. 3)}$$

In other embodiments, the cable drive system 700 can employ a direct cable drive with no tensioning means. In some embodiments, for example, the cable can be wound around the take-up cylinder 410 in the opposite direction of the screen 120. The cable can then run to a pulley located in the bottom of the extrusion 110 and back up to the screen 120. In this manner, when the take-up cylinder 410 is rotated to unfurl the screen 120 (either manually or with an electric motor, for example); the cable is wound onto the take-up cylinder 410 pulling the screen down. In some embodiments, two or more cables can be used, wound in opposite directions, to provide positive movement of the screen 120 in both directions. Of course, other cable and pulley configurations are possible and are contemplated herein.

Figure 8:
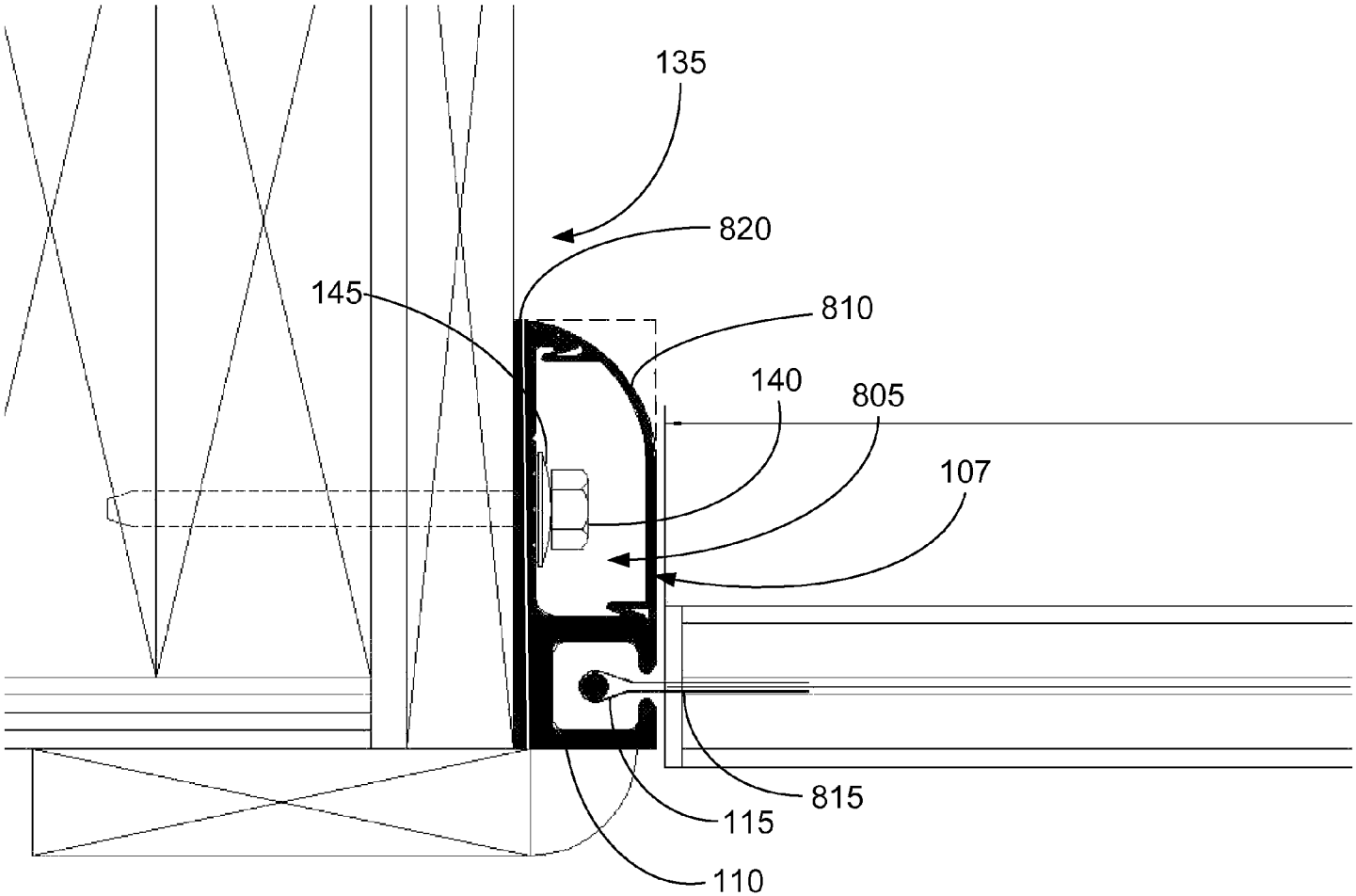
FIG. 8 depicts a top, detailed view of the retention track and cover for the storm shield system, in accordance with some embodiments of the present invention.

As shown in FIG. 8, the side support unit 107 can further define a compartment 805 sized and shaped to house the cable drive system 700, remote control receivers, and/or electrical connections for an electric motor 250. A cap, or cover, 810 can be clipped over the compartment 805 to cover the device and wires. In some embodiments, the cover 810 can be non-metallic to enable RF transmission to and from remote control receiver/transmitters. In other embodiments, the cover 810 can be transparent or translucent to enable the use of infrared remote transmitters. The cover 810 can have various profiles to meet various functional, aesthetic, or architectural needs. The cover 810 can also have various finishes to, for example and not limitation, match wall or trim colors or to simulate various finishes or materials. The cover 810 can comprise, for example, plastic, aluminum, or pot metal, and can comprise the same material as the side support unit 107 or a different material.

The material used for the screen 120 preferably has high strength and light transfer with reasonable visibility and clarity, while still protecting the opening from wind driven rain and missiles, among other things. In some embodiments, the screen 120 can comprise a woven material comprising high-tenacity polyester threads with a PVC coating in the warp direction and a Kevlar® (or generic equivalent) with a PVC coating in the fill direction. The diameter of the polyester and Kevlar coated yarns can vary as well as the warp and fill construction (number of threads per inch) depending on intended use. The material can be thermally set to, among other things, prevent the threads from unraveling when cut. The PVC coating can be colored. This material can provide all four capabilities, i.e., solar, insect, thermal, and storm (or, "SITS") in one material. The screen 120 can further comprise other commercially available fabric materials and can use the base material to establish the loop required for the side retention system.

In other embodiments, the screen 120 can comprise a sandwich, or bonded layers, of materials comprising, for example and not limitation, clear vinyl, Mylar®, PVC, fiberglass, or Dynema®. In some embodiments, one or more layers of the screen 120 can include a scrim comprising, for example, square, rectangle, or diamond shapes. In one preferred embodiment, the following components can be layered in the following sequence to form the screen 120 material: Clear vinyl; Mylar; a fiberglass carrier grid supporting a Dynema® scrim forming square, rectangle, or diamond shapes; and clear vinyl. This sandwich of materials can be, for example, chemically bonded (glued) or mechanically bonded using pressure, with or without heat, during the manufacturing process.

In still other embodiments, the screen 120 can comprise an additional light control layer or a different material to reduce or eliminate light infiltration (e.g., a "black-out" screen). In some embodiments, the black-out material can be incorporated as an extra layer of the screen 120. In other embodiments, the black-out material can be separately deployed. In other words, the system can be deployed in two parts, for example, with the screen protection system 100, 200 installed on the outside of the penetration and a separate black-out system deployed on the inside of the penetration. In this configuration, both storm protection and light infiltration control can be provided.

In other embodiments, the vertical sides of the screens 120 can further comprise a band or edging 815 sewn vertical edges of the screen 120. In some embodiments, the edging 815 can form the loops 115 in the screen 120. In other embodiments, the edging can be sewn over the loops 115. In some embodiments, a fabric system such as, but not limited to, Dacron® luff tape can be used to reduce friction between the loop 115, the hem rod 105, and the retention channel 110. In some embodiments, the luff tape can further comprise Teflon® thread, or other low friction materials, woven into, or adhered to, the banding for added lubricity.

The side support unit 107 can further comprise closed cell foam or rubber backing 820 disposed between the side support unit 107 and the mounting surface 135 to prevent air and water leakage between side support unit 107 and the surface 135. In a preferred embodiment, the side support unit 107 can be affixed to the structure 135 using a fastener 140 with a sealing washer 145. The sealing washer 145 can comprise rubber, plastic, or other material suitable for forming a water tight seal between the fastener 140 and the side support unit 107. In a preferred embodiment, the fastener 140 can comprise a stainless steel and EPDM rubber bonded washer 145 between the head of the fastener 140 and the side support unit 107. The washer 145 can prevent both leaking and galvanic corrosion where the fastener 140 penetrates the side support unit 107 and the mounting surface 135.

Figure 9:
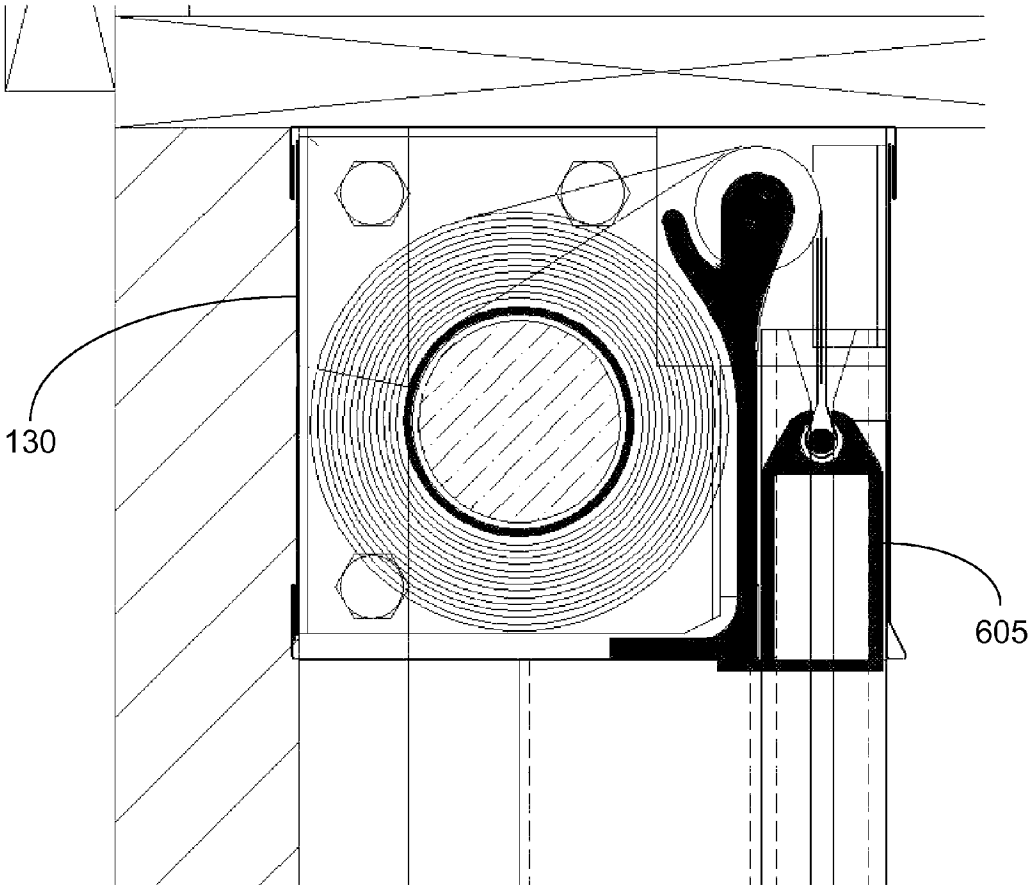
FIG. 9 depicts a cross-sectional view of the enclosure for the storm shield system with the weight bar in a retracted position, in accordance with some embodiments of the present invention.

In some embodiments, as shown in FIG. 9, the side support unit 605 can be sized and shaped such that it can be substantially or totally retracted into the enclosure 130. In this configuration, the aesthetic impact of the enclosure 130 can be minimized (e.g., a simple box). In addition, when retracted, the side support unit 605 can be prevented from swinging or rattling when not in use.

Figure 10B:
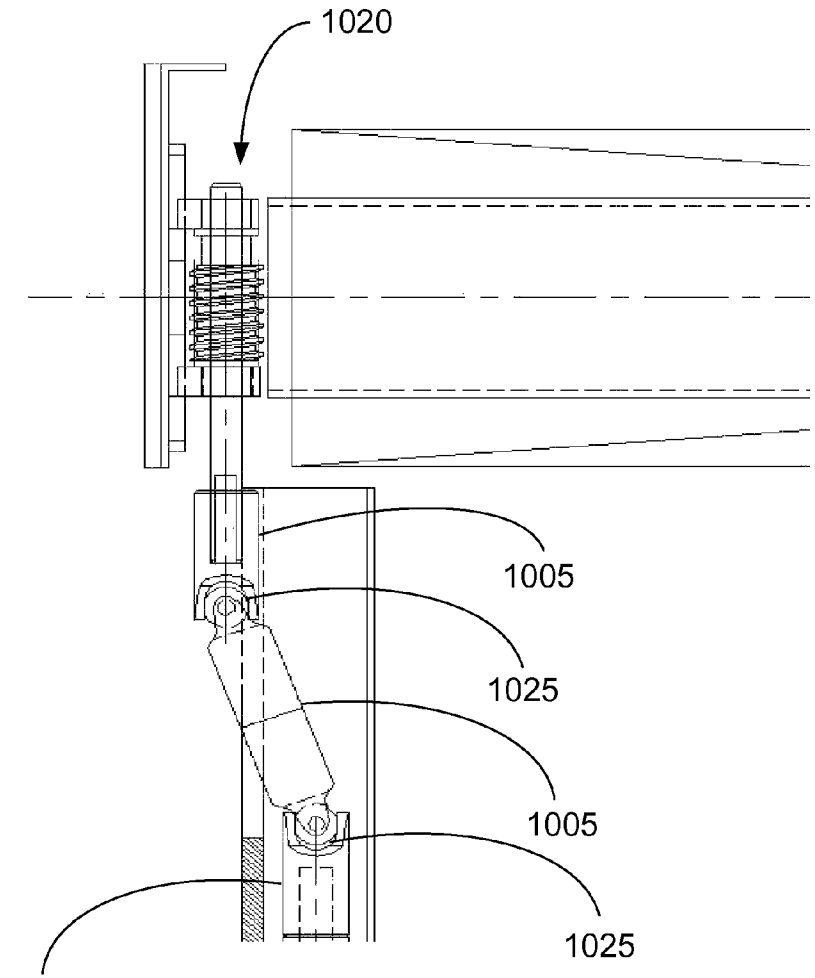
FIGS. 10*a* and 10*b* depict side and front views, respectively, of a remote drive mechanism for use with the storm shield system, in accordance with some embodiments of the present invention.
Figure 10A:
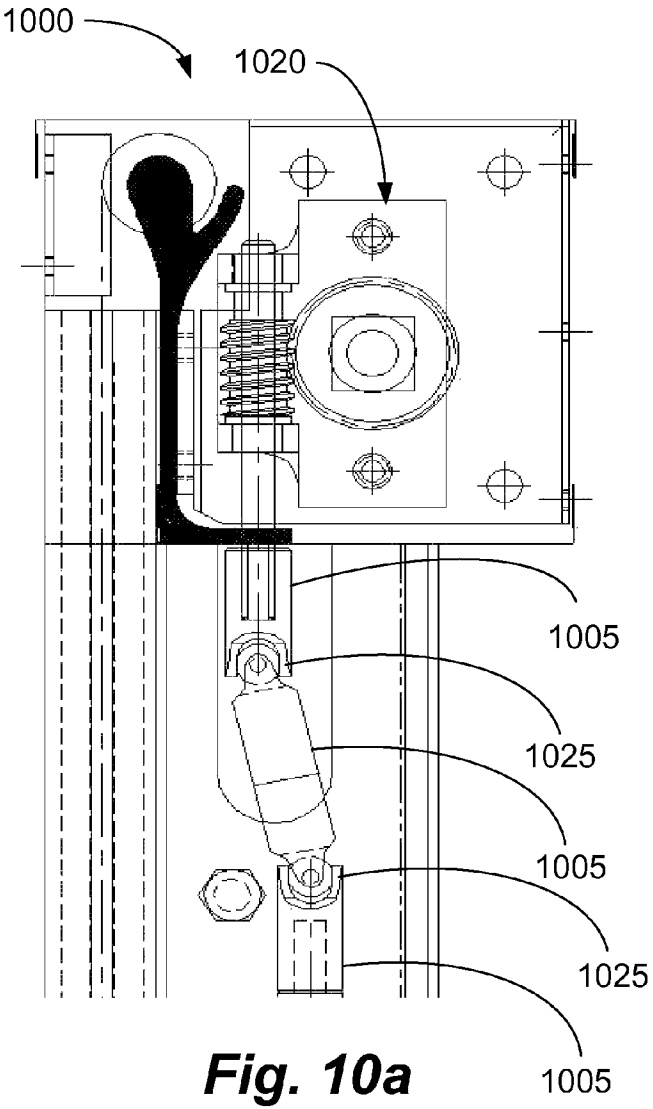

As shown in FIGS. 10*a* and 10*b*, the ability to deploy the system from the inside of the building can also be provided on an external mount installation with the proper hardware. The system 1000 can comprise a remote drive system comprising one or more driveshafts 1005 coupled to a drive mechanism 1020. In some embodiments, the driveshafts 1005 can be coupled to the drive mechanism 1020, and each other, by one or more universal joints 1025. This can enable, for example, the drive handle for the screen 120 to be remotely located. This can be useful, for example, for a very tall window to enable the drive handle to be located at a lower, safer, more convenient location. This drive system 1000 can also enable a drive motor 250 to be located remotely from the enclosure, if desired.

Figure 11A:
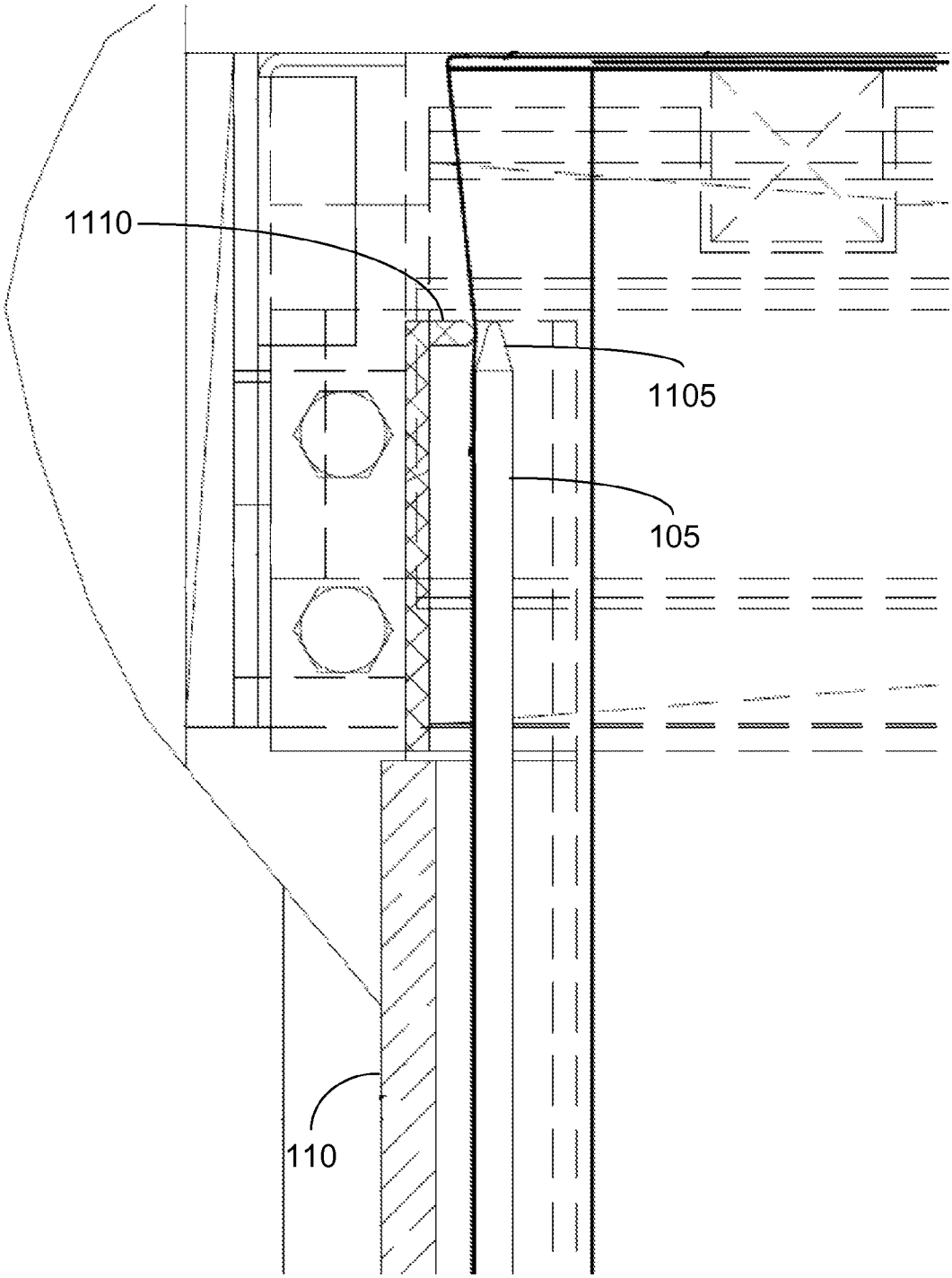
FIG. 11*a* depicts a side view of smooth loop opener for use with the storm shield system, in accordance with some embodiments of the present invention.
Figure 11B:
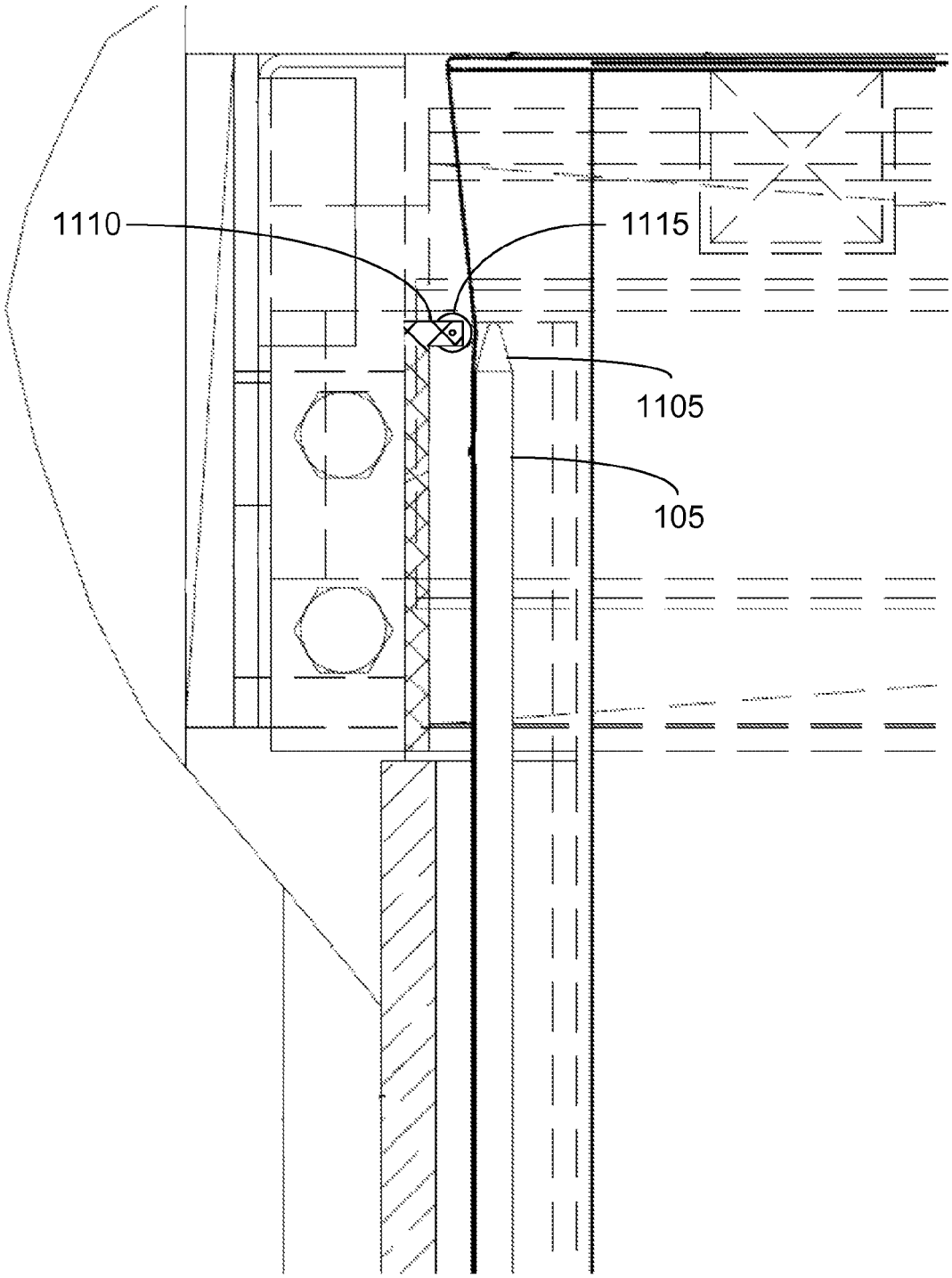
FIG. 11*b* depicts a side view of a roller loop opener for use with the storm shield system, in accordance with some embodiments of the present invention.

Referring now to FIGS. 11*a* and 11*b*, when the screen 120 is wound around the take-up cylinder 410, the loop 115 sewn into the sides of the screen 120 tends to flatten. This is advantageous in that it minimizes the storage space required to store the screen 120 when not in use. When the screen 120 is deployed, however, it is desirable to open the loop 115 in the screen 120 to enable it to slide easily over the end 1105 of the hem rod 105. This can prevent, for example, jams and damage to the screen 120 from improper deployment.

As shown in FIG. 11*a*, therefore, in some embodiments the system can further comprise a loop opener 1110. The loop opener 1110 can comprise a projection, or roller, disposed in one or both retention channels, proximate the upper ends 1105 of the hem rods 105. It should be noted that the loop opener would generally be positioned in the bottom of the retention channel in the bottom-up configuration. As the screen 120 is deployed past the loop opener 1110, the edge of the screen 120 is pushed inward by the loop opener 1110, causing the loop 115 to open as it comes off the roll 410. This can enable the loop 115 to start over the top 1105 of the hem rod 105 and can prevent jams and bunching during initial deployment.

In some embodiments, the end of the hem rod 105 can comprise a tapered upper portion 1105 to help start the loops 115 in the screen 120 over the end 1105 of the hem rod 105. The tapered portion 1105 can comprise a separate piece, or cap, placed on top, or inserted into the top end of the hem rod 105. In other embodiments, the tapered portion 1105 can be cast, molded, or machined into the end of the hem rod 105 such that the hem rod and the tapered portion 1105 are unitary. In some embodiments, the tapered portion 1105 can be made from the same material as the hem rod 105. In other embodiments, the tapered portion 1105 can comprise a different material than the hem rod 105 that has desirable properties such as, for example and not limitation, a low coefficient of friction. The tapered portion 1105 can be made from, for example and not limitation, metal, plastic, fiberglass, composite material, wood, or combinations thereof. In some embodiments, the taper portion 1105 can further comprise a low-friction coating such as, for example and not limitation, Teflon®.

As shown in FIGS. 11*a*, the loop opener 1110 can be a simple projection, or finger, disposed in the retention channel 110 near the top 1105 of the hem rod 105. The loop opener 1110 can be part of the retention channel 110 or can be a separate part affixed to the retention channel 110 during manufacture. In some embodiments, the loop opener 1110 can comprise a low-friction material or can be coated in a low-friction material to reduce wear the screen 120. As shown in FIG. 11*b*, in other embodiments, the loop opener 1110 can further comprise a wheel 1115 or ball on the end of the projection to further reduce wear on the screen 120.

Figure 11C:
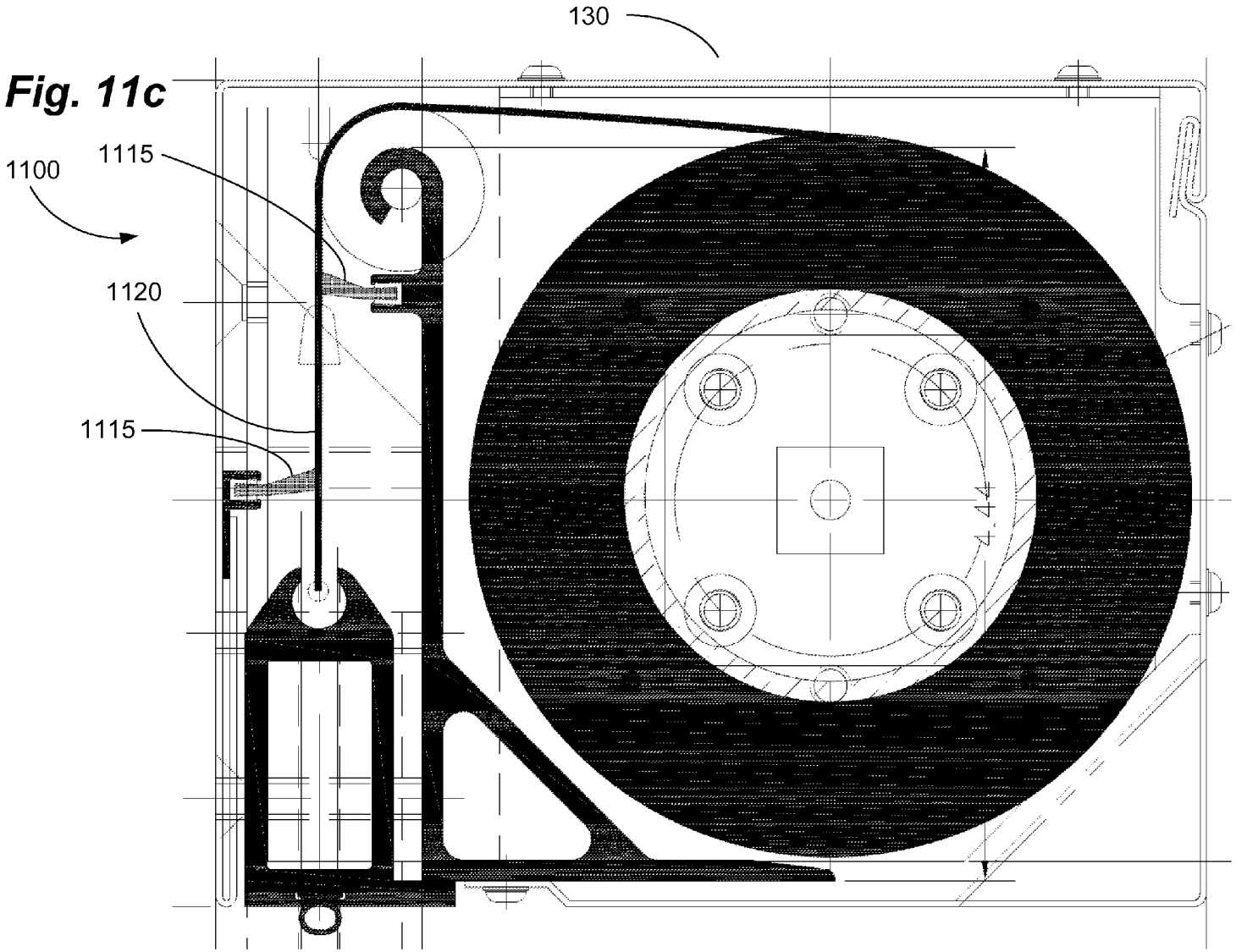
FIG. 11*c* depicts a side view of screen wipers for use with the storm shield system, in accordance with some embodiments of the present invention.

As shown in FIG. 11*c*, in some embodiments, the enclosure 130 can further comprise a screen wiping system 1100. The screen wiping system 1100 can comprise one or more wipers 1115 or brushes disposed on one or more sides of the screen 120 near or inside the enclosure 130. The wipers 1115 can remove debris from the screen 120 that may have accumulated during use as the screen 120 retracts into the enclosure 130. This can prevent debris such as, for example and not limitation, insects and dirt from being drawn into the enclosure 130.

The wipers 1115 can comprise a variety of designs and can form a narrow slot through which the screen 120 can travel during extension and retraction. In some embodiments, the wipers 1115 can be rubber and can be similar in construction to wiper blades on a vehicle. In other embodiments, the wipers 1115 can be brushes, or other flexible means, suitable to wipe the screen 120 during use. In still other embodiments, the wipers 1115 can comprise a narrow slit of plastic, or other rigid or semi-rigid material. In some embodiments, the wipers 1115 can act in concert with, or instead of, the loop opener 110 to open the loops 115 in the screen 120 as they travel over the ends of the hem rods 105.

Embodiments of the present invention can further comprise a method of installing the system 400 for a trapped configuration. In this configuration, the enclosure 130 can be mounted inside the window or door opening. In some embodiments, the enclosure 130 can comprise a rubber, or high-density foam, backing 420 to seal adjacent surfaces of the enclosure 130 to the mounting surface 505. The retention channels 110 can be installed on the vertical sides of the opening 405. In some embodiments, the retention channels 110 can comprise multiple pieces to facilitate installation and repair. In some embodiments, the retention channels 110 can comprise a rubber, or high-density foam, backing 425 to seal adjacent surfaces of the channels 110 to the mounting surface 405. In some embodiments, installation may further comprise installing and/or connecting remote control electronics, remote drive systems, and/or additional trim pieces.

The retention channels 110 and/or the enclosure 130 can be affixed to the structure using, for example and not limitation, screws, bolts, or rivets. In some embodiment, the fasteners 140 can further comprise a sealing washer 145 to prevent air and water leaks and galvanic corrosion between the fastener 140, channels 110, enclosure 130, and structure 405. Installation for the face-mounted configuration 500 is substantially similar with the exceptions that the enclosure 130 and channels 110 are mounted on the outside of the window or door opening, e.g., on the window trim 505.

In some embodiments, the system can be installed with the enclosure 130 on the left or right side of an opening and the retention channels 110 on the top and bottom of the opening (i.e., such that the screen 120 deploys horizontally). This may be necessary due to the type of opening or the type of window or door in the opening. The installation procedure can be substantially the same, though rotated 90 degrees in all respects. A system installed in this manner would not have the benefit of gravity during deployment, as in the top-down system, and thus may need to be manually deployed or be cable assisted. The system would nonetheless function as intended.

Figure 12:
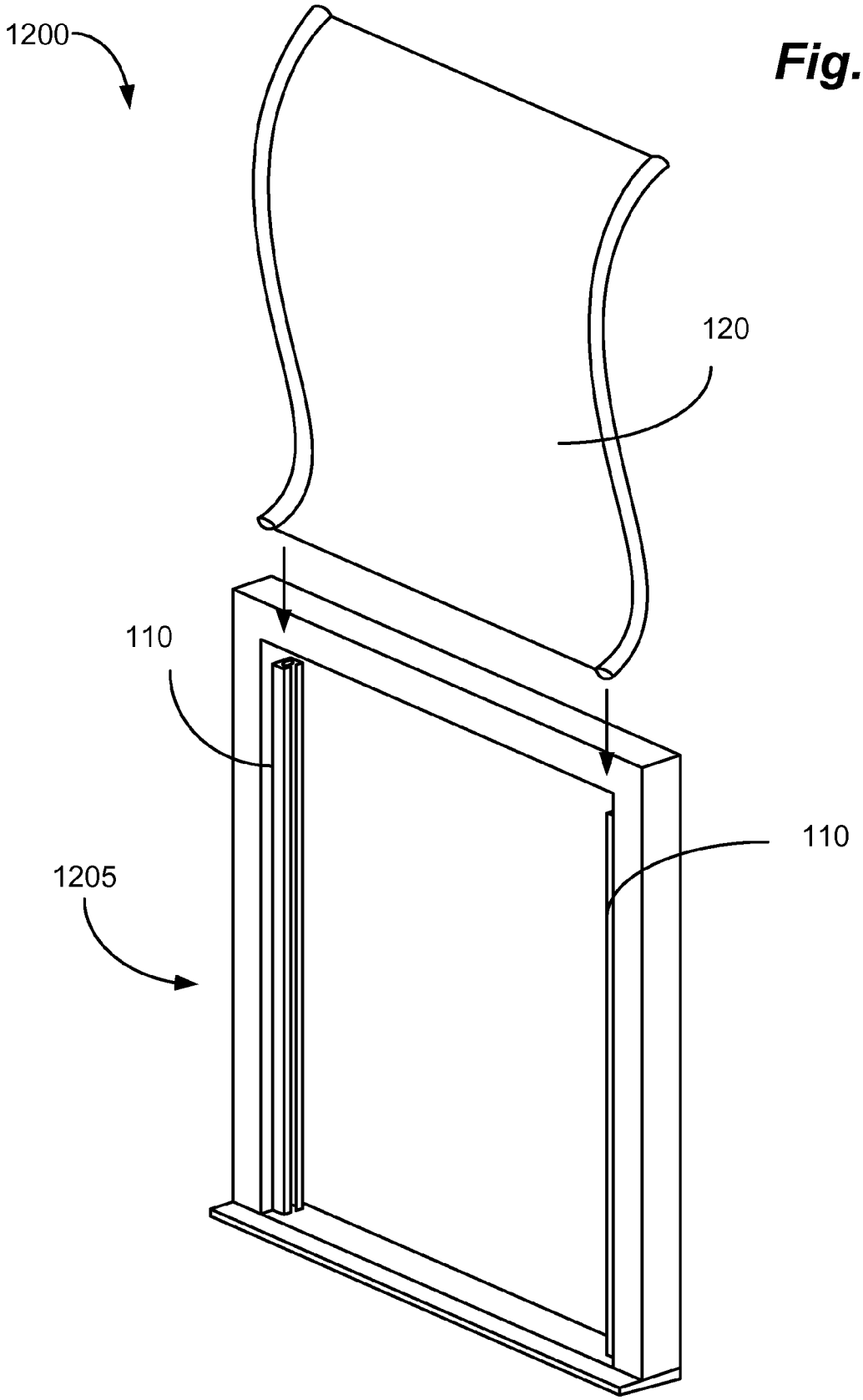
FIG. 12 depicts a manually deployed storm shield system, in accordance with some embodiments of the present invention.

As shown in FIG. 12, in still other embodiments, the system 1200 can be manually deployed. In other words, the system 1200 can comprise retention channels 110 and the screen 120 with no enclosure 130 or deployment mechanisms 1020. In this configuration, the user can simply install the retention channels 110 on either side of the penetration 1205, and then slide the screen 120 down over the hem rods 105 and into the retention channels 110. The screen 120 can then be secured at the bottom and/or the top of the penetration 1205 as desired.

This configuration can be useful if the subject building is, for example, a summer home. The user can deploy screen 120 over some or all of the external building penetrations at the end of the season. The user can then remove the screens 120 at the beginning of the season when reopening the house. Because there is no hem cord, the screens 120 can be stacked and stored flat or rolled up. In either case, the system can be stored in minimal space. In addition, because the system is somewhat simplified (e.g., there is no enclosure 130, motor 250, or deployment mechanisms 700), the cost of purchasing, installing, and maintaining the system 1200 is reduced. Finally, the aesthetic impact to the structure is minimized because, when removed, only the retention channels 110 remain on the building. In some embodiments, the retention channels 110 can also be removable, substantially eliminating aesthetic impact.

Figure 13:
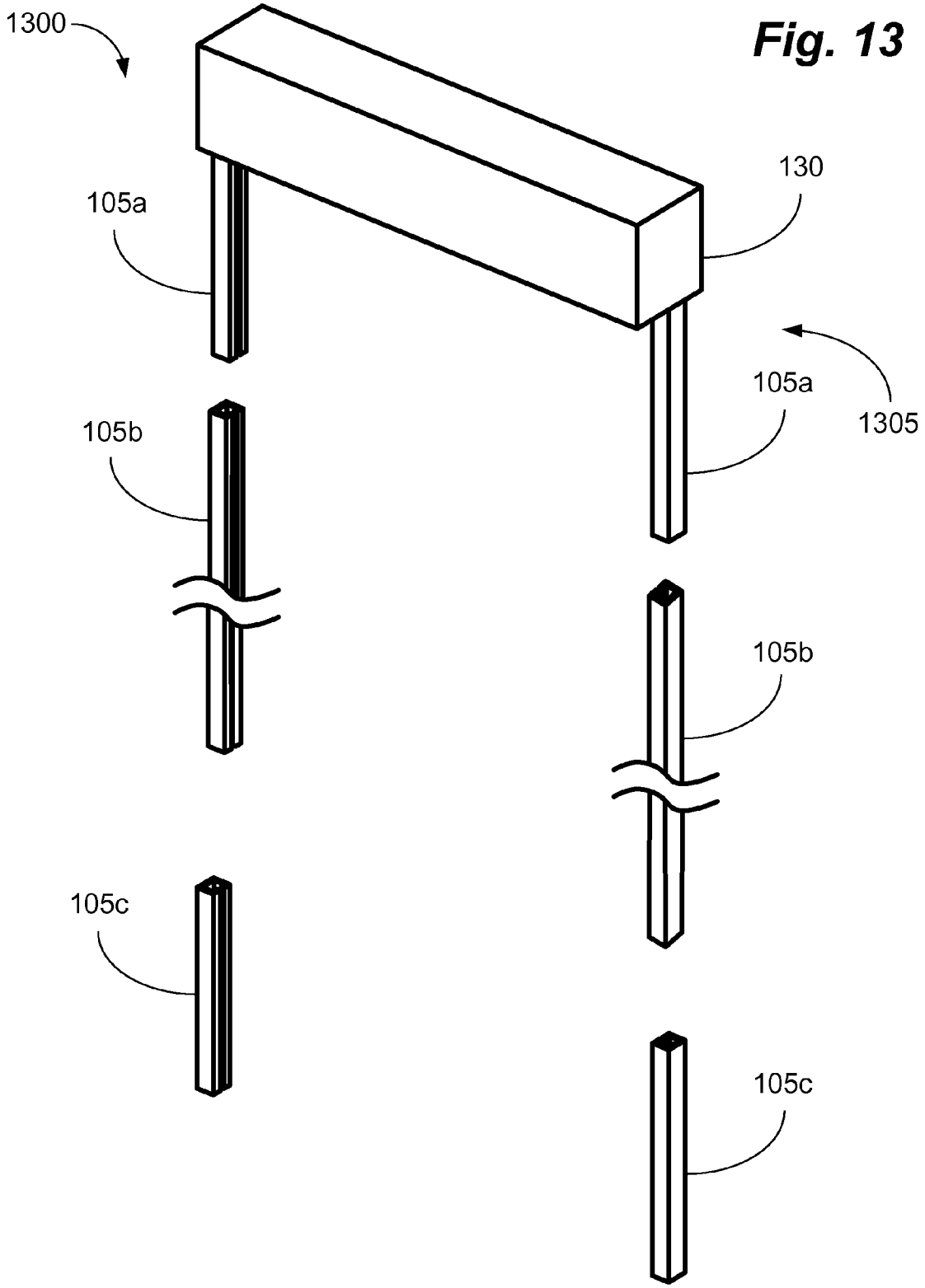
FIG. 13 depicts side, perspective view a modular storm shield system, in accordance with some embodiments of the present invention.

As shown in FIG. 13, embodiments of the present invention can also comprise a modular system 1300 for protecting building penetrations. In this configuration, the system 1300 can comprise three main components: the enclosure 130 and upper retention channel 105*a* (collectively, the upper system 1305), the middle retention channel 105*b*, and the lower retention channel 105*c*. In this manner, the system 1300 can be assembled offsite and can be easily customized to a particular building opening. In some configurations, the upper system 1305 can contain a majority of the system components including, for example and not limitation, the screen 120, upper pulley system 750, and take-up cylinder 210. The lower retention channel 105*b*, on the other hand, can contain, for example and not limitation, the lower pulley system 760. In some embodiments, the middle retention channel 105*b* can be substantially free of components, or can contain pulleys or cables, as necessary. The length of the middle retention channel 105*b* can be adjusted to adapt the system 1300 to a particular opening height.

In this manner, substantially all building penetrations of a particular width can use the same upper system 105 and lower retention channel 110*c*. The height of the system 1300 can be customized to a particular opening by varying the length of the middle retention channel 110*b*. In this configuration, a majority of the components for the system 1300 can be installed at the factory to, among other things, lower cost, improve quality, and reduce on-site installation time. Many of the components of the cable drive system 700, for example, can be installed in the upper 110*a* and lower 110*c* retention channels, while the motor, screen 125, and take-up cylinder 210, for example, can be installed in the enclosure 130.

As discussed above, a majority of system components (e.g., the enclosure 130, the upper retention channel 110*a*, the upper pulley system 750, screen 125, and take-up cylinder 210) can be assembled as a unit to form the upper system 105. This configuration can decrease cost and improve quality and can also reduce the amount of time and skill required for system installation. During installation, for example, the installer can first install the upper system 105 as a unit, then the middle 110*b* and lower 110*c* retention channels. After these components have been installed, the installer has only to make the necessary mechanical and electrical connections and installation of the system 1300 is complete.

This configuration also facilitates repair in the field. If the motor 250 were to fail, for example, service personnel could merely remove the upper system 105 and either repair or replace the motor. In a large installation with multiple identical systems 1300, on the other hand, it may be more feasible for service personnel to simply exchange the upper system 105 with a new or rebuilt unit. The unit 105 that has failed can then be returned to the factory or workshop for benchtop repair (i.e., as opposed to attempting repairs on a ladder or scaffold). In the event of a pulley 710 or cable 705 failure in the lower pulley system 760, for example, service personnel can simply replace the entire lower retention channel 110*c* with a replacement and then dispose of, or repair, the broken components in the removed unit 110*c*. This modular design can facilitate easy and safe repair of the system 1300 minimizing cost and downtime.

In some embodiments, it may be necessary or desirable to provide positive attachment of all system components to the system itself or to the building. In other words, it may be desirable to ensure that control of all system components can be maintained to prevent injury from falling objects and to prevent damage to the components during installation and/or service.

Figure 14:
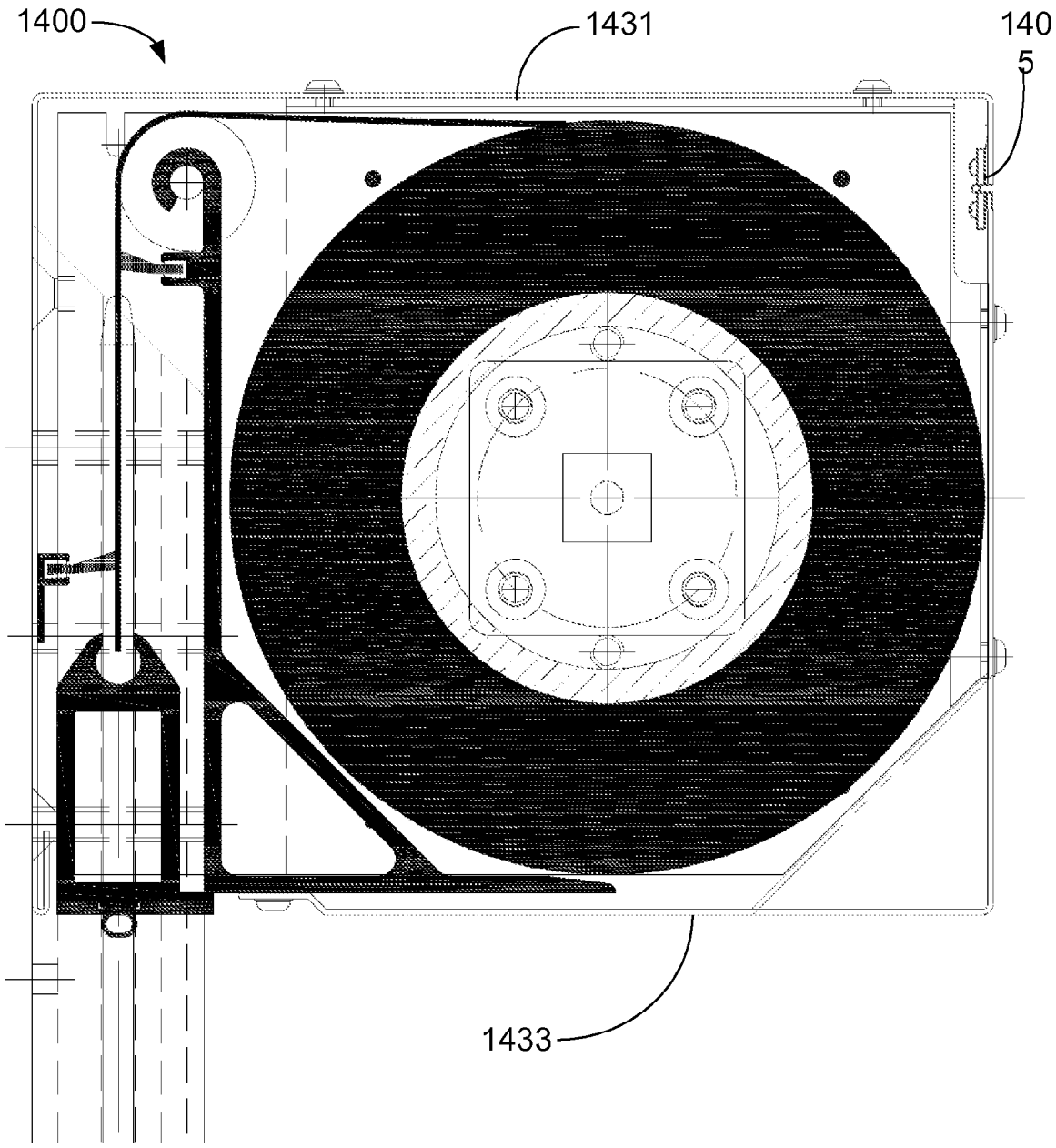
FIG. 14 depicts a cross-sectional view of the enclosure for the storm shield system with a hinged cover, in accordance with some embodiments of the present invention.

As shown in FIG. 14, therefore, it may be necessary or desirable, for example, to provide a hinged cover 1433 for the enclosure 130. In this configuration, the cover 1433 can be opened to enable access to interior components during installation and/or service. Because the cover 1433 is hingedly attached to the mount 1431, however, service and repair can be safely performed without fear of accidentally dropping the cover 1433 from height. The cover 1433 can be attached using one or more standard hinges 1405 or can be attached using, for example and not limitation, a piano hinge, a flexible strip, or wire ties.

In some embodiments, substantially all of the removable components can be tethered, or otherwise affixed, to the building or the system 1400 to prevent dropping components. Referring back to FIG. 2*a*, for example, the motor 250 and/or motor pins 240 can further comprise a tether 244 to tether the motor 250 and/or pins 240 to the enclosure 130 or mounting bracket 245. This can be particularly useful when installing or servicing the system 1400 in high installation locations. Similar means can be used for all components in a permanent or temporary manner to ensure that installation and/or repair can be affected in a safe manner.

Figure 15:
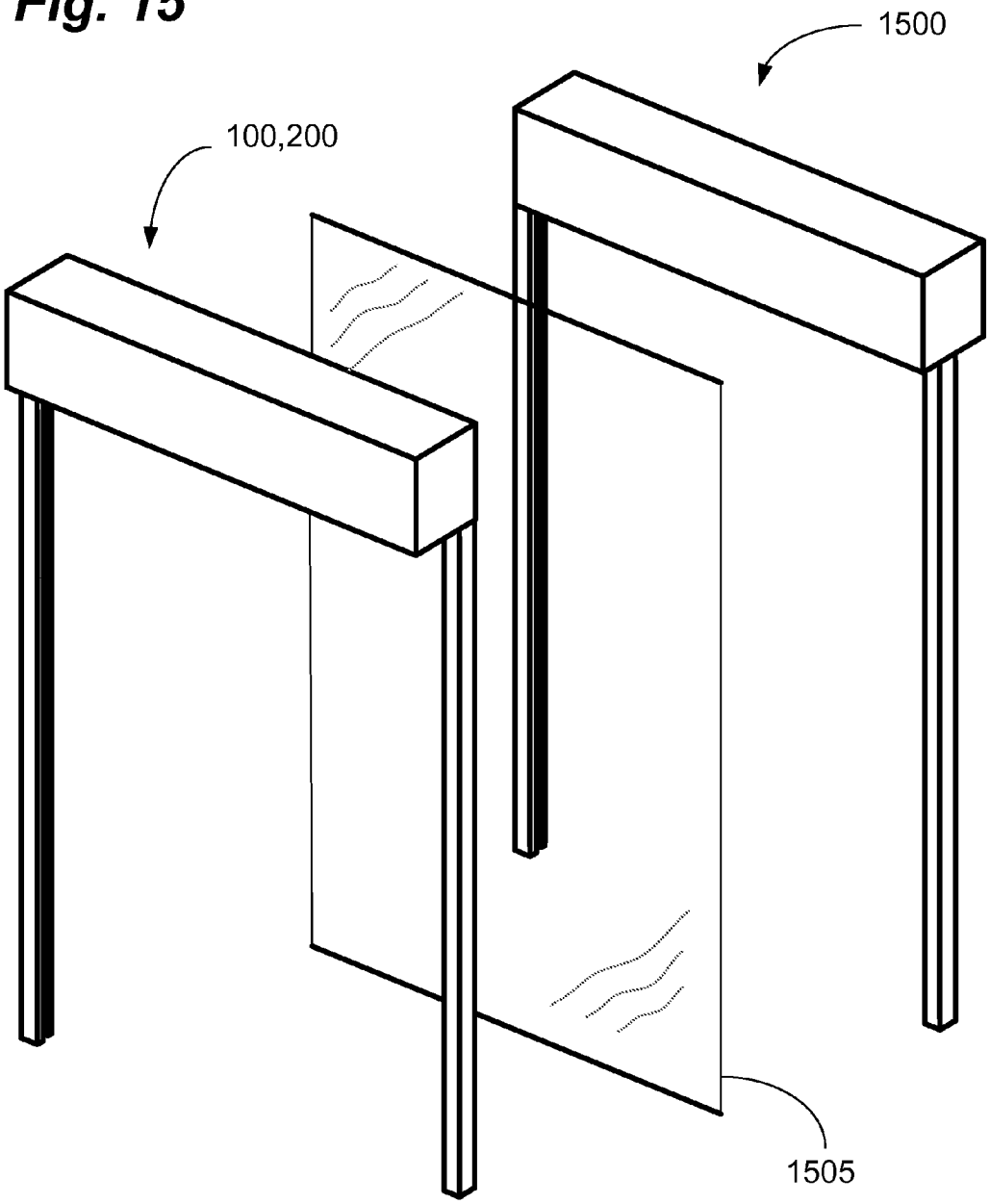
FIG. 15 depicts a perspective view of the storm shield system in conjunction with a black-out system, in accordance with some embodiments of the present invention.

Embodiments of the present invention can further comprise a light control, or "black-out" system 1500. As shown in FIG. 15, in some embodiments, the light control, or "black-out" system 1500 can be used in conjunction with, or instead of, the storm protection system 100, 200. In this configuration, the storm control system 100,200 can be installed to protect, for example, the outside of a window opening 1505 and a separate black-out system 1500 can be installed inside the opening 1505. The black-out system 1500 can be substantially the same as the storm control system 100, 200, but with a screen 120 specifically chosen to provide a given light emissivity.

In other embodiments, the black-out system 1500 can simply be an additional layer provided on the screen 120 of the storm control system 100, 200. In still other embodiments, the storm control system 100,200 and the black-out system 1500 can be combined in the same enclosure 130. In other words, the enclosure 130 can comprise two take-up rolls 210, one for the storm shield system 100, 200 and one for the black-out system 1500. Of course, either system 100, 200, 1500 can be used independently of the other, as desired.

While several possible embodiments are disclosed above, embodiments of the present invention are not so limited. For instance, while several possible configurations of materials for the screen have been disclosed, other suitable materials and combinations of materials could be selected without departing from the spirit of embodiments of the invention. In addition, the location and configuration used for various features of embodiments of the present invention can be varied according to a particular opening or building design that requires a slight variation due to, for example, the materials used and/or space or power constraints. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A system for protecting a penetration of a building comprising:

a first enclosure comprising:

a screen disposed proximate an outside of a building penetration and comprising a first end, a second end, a first loop disposed on a first side, and a second loop disposed on a second side;

a first weight bar coupled to the second end of the screen; and a first take-up roll, attached to the first end of the screen about which a non-deployed portion of the screen is wound;

first and second side members each comprising a channel and a rigidly fixed, tapered hem rod disposed in the channel, the hem rods sized and shaped to fit inside and locate the first and second loops as the screen deploys;

each of the first and second side members further having a loop opener comprising one of a projection or roller disposed in the channel proximate a tapered end portion of each hem rod and configured to open the first and second loop of the screen by pushing an edge of the screen; and a first cable drive system coupled to the second end of the screen for providing tension to the screen as it deploys.

2. The system of claim 1, wherein the first weight bar fully retracts into the enclosure when the screen is in a fully retracted position.

3. The system of claim 1, further comprising:

a second enclosure comprising:

a black-out screen disposed proximate the inside of a building penetration and comprising a first end, a second end, a first loop disposed on a first side, and a second loop disposed on a second side;

a second weight bar coupled to the second end of the black-out screen; and a second take-up roll, attached to the first end of the black-out screen about which a non-deployed portion of the black-out screen is wound; and third and fourth side members each comprising a channel and a hem rod disposed in the channel, the hem rods sized and shaped to fit inside the first and second loops as the black-out screen deploys.

4. The system of claim 3, further comprising, a second cable drive system coupled to the second end of the black-out screen for providing tension to the black-out screen as it deploys.

5. The system of claim 3, wherein the second weight bar fully retracts into the enclosure when the screen is in the fully retracted position.

6. The system of claim 1, wherein the first weight bar further comprises a seal disposed on one or more surfaces of the first weight bar for sealing the weight bar against the building penetration.

7. The system of claim 1, the first enclosure further comprising:

a guide disposed proximate to, and substantially parallel with, the first take-up roll and comprising a rounded profile for guiding the screen as it is moved between a first, retracted position and the second, deployed position.

8. The system of claim 7, wherein the guide comprises one or more rollers.

9. The system of claim 1, further comprising one or more wipers disposed proximate the screen for removing debris from the screen as it is moved between a first, retracted position and the second, deployed position.

10. A system for protecting a penetration of a building comprising:

an enclosure comprising:

a screen for protecting a building penetration and comprising a first end, a second end, a first loop disposed on a first side, and a second loop disposed on a second side;

a weight bar coupled to the second end of the screen; and a take-up roll, attached to the first end of the screen about which a non-deployed portion of the screen is wound;

two side members each comprising a channel and a tapered hem rod disposed in the channel, the hem rods sized and shaped to fit inside the first and second loops as the screen deploys;

each of the first and second side members further having a loop opener comprising one of a projection or roller disposed in the channel proximate a tapered end portion of each hem rod and configured to open the first and second loop of the screen by pushing an edge of the screen; and a cable drive system coupled to the second end of the screen to provide tension to the second end of the screen as it deploys, the cable drive system comprising:

a tensioner comprising a first, relaxed position, a second, tensioned position, a first end, and a second end;

an upper drive pulley system coupled to the first end of the tensioner; and a lower drive pulley system coupled to the second end of the tensioner;

wherein the tensioner provides minimum downward tension when the screen is retracted and maximum downward tension when the screen is deployed.

11. The system of claim 10, wherein the lower drive pulley system and the upper drive pulley system comprise different gear ratios to move the tensioner from the first position to the second position as the screen is deployed.

12. The system of claim 11, wherein the gear ratio of the lower pulley system is approximately between two and five times the gear ratio of the upper pulley system.

13. The system of claim 10, wherein the screen further comprises a light control layer.

14. The system of claim 10, further comprising:

a guide that is substantially the same width as, and parallel to, the take-up roll;

wherein the screen is deployed over the guide to maintain substantially constant deployment and retraction angles.

15. The system of claim 10, wherein the enclosure comprises:

a mount; and a cover hingedly coupled to the mount to enable access to internal components.

16. The system of claim 10, wherein the one or both of the side members further comprise a compartment for housing one or more system components, spare parts, or both.

17. The system of claim 16, wherein the one or both of the side members further comprise a moveable cover to provide access to the compartment.

18. The system of claim 10, wherein the loops are welded, sewn, or both into the sides of the screen.

19. A system for protecting a penetration of a building comprising:

an enclosure comprising:

a screen for protecting a building penetration and comprising a first end, a second end, a first loop disposed on a first side, and a second loop disposed on a second side;

a weight bar coupled to the second end of the screen;

a take-up roll, attached to the first end of the screen about which a non-deployed portion of the screen is wound; and two upper side members each comprising a channel;

two middle side members each comprising a channel; and two lower side members each comprising a channel and a tapered hem rod, the hem rods sized and shaped to fit inside the first and second loops as the screen deploys;

each of the first and second side members further having a loop opener comprising one of a projection or roller disposed in the channel proximate a tapered end portion of each hem rod and configured to open the first and second loop of the screen by pushing an edge of the screen.

20. The system of claim 19, further comprising a cable drive system coupled to the second end of the screen for providing tension to the screen as it deploys.

21. The system of claim 20, the cable drive system further comprising:

an upper cable drive system comprising one or more pulleys and one or more cables disposed in one or both of the two upper side members; and a lower cable drive system comprising one or more pulleys and one or more cables disposed in one or both of the two lower side members.

22. The system of claim 20, wherein the upper cable drive system and the lower cable drive system are elastically coupled with a tensioner.

23. The system of claim 1, further comprising a locking system configured to secure the screen in a deployed position.

* * * * *